US007833408B2

(12) United States Patent
Ramamurthy

(10) Patent No.: US 7,833,408 B2
(45) Date of Patent: Nov. 16, 2010

(54) STAGED HYDROCARBON CONVERSION PROCESS

(75) Inventor: Pritham Ramamurthy, Sugar Land, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 498 days.

(21) Appl. No.: 11/964,162

(22) Filed: Dec. 26, 2007

(65) Prior Publication Data

US 2008/0099379 A1 May 1, 2008

Related U.S. Application Data

(63) Continuation-in-part of application No. 11/634,297, filed on Dec. 5, 2006, now abandoned, which is a continuation of application No. 10/707,997, filed on Jan. 30, 2004, now Pat. No. 7,144,498.

(51) Int. Cl.
*C10G 55/04* (2006.01)

(52) U.S. Cl. ..... 208/52 R; 208/49; 208/57; 208/54; 208/390

(58) Field of Classification Search ..... None
See application file for complete search history.

(56) References Cited

U.S. PATENT DOCUMENTS

| | | | |
|---|---|---|---|
| 2,756,186 | A | 7/1956 | Owen et al. |
| 3,310,484 | A | 3/1967 | Mason et al. |
| 3,549,519 | A | 12/1970 | Munro et al. |
| 3,817,853 | A | 6/1974 | Folkins |
| 4,178,228 | A | 12/1979 | Chang |
| 4,264,432 | A | 4/1981 | Gartside |
| 4,298,455 | A | 11/1981 | Huang |
| 4,341,619 | A | 7/1982 | Poska |
| 4,354,922 | A | 10/1982 | Derbyshire et al. |
| 4,376,693 | A | 3/1983 | Warzel |
| 4,390,411 | A | 6/1983 | Scinta et al. |
| 4,448,669 | A | 5/1984 | Scinta |
| 4,455,219 | A | 6/1984 | Janssen et al. |
| 4,482,453 | A | 11/1984 | Coombs et al. |
| 4,483,761 | A | 11/1984 | Paspek, Jr. |
| 4,518,487 | A | 5/1985 | Graf et al. |
| 4,548,711 | A | 10/1985 | Coombs |
| 4,557,820 | A | 12/1985 | Paspek, Jr. et al. |
| 4,559,127 | A | 12/1985 | Paspek, Jr. |
| RE32,120 | E | 4/1986 | Low |
| 4,588,476 | A | 5/1986 | Warzel |
| 4,592,826 | A | 6/1986 | Ganguli |
| 4,594,141 | A | 6/1986 | Paspek, Jr. et al. |

(Continued)

*Primary Examiner*—Tam M Nguyen
(74) *Attorney, Agent, or Firm*—KBR IP Legal Dept.

(57) ABSTRACT

Systems and methods for staging an investment in hydrocarbon processing are provided. In a first stage, a hydrocarbon feed can be apportioned equally or unequally into first and second portions. The first portion can be mixed with one or more oxidants and gasified to provide a first effluent, at least a portion of which can be combusted to provide steam. The second portion can be mixed with one or more solvents to provide one or more fungible hydrocarbon products, at least a portion of which can be sold to generate capital. In a second stage, the hydrocarbon feed can be mixed with one or more solvents and one or more non-catalytic solids and the resultant mixture thermally cracked to provide one or more hydrocarbon products and coked non-catalytic solids. The coked, non-catalytic solids can be regenerated and recycled.

11 Claims, 16 Drawing Sheets

U.S. PATENT DOCUMENTS 4,604,185 A 8/1986 McConaghy, Jr. et al.
4,604,188 A 8/1986 Yan et al.
4,615,791 A 10/1986 Choi et al.
4,640,762 A 2/1987 Woods et al.
4,642,175 A 2/1987 Rudnick
4,661,241 A 4/1987 Dabkowski et al.
4,673,486 A 6/1987 Orihashi et al.
4,719,000 A 1/1988 Beckberger
4,784,746 A 11/1988 Farcasiu et al.
4,818,370 A 4/1989 Gregoli et al.
4,840,725 A 6/1989 Paspek
4,944,863 A 7/1990 Smith et al.
5,370,787 A 12/1994 Forbus
5,443,715 A 8/1995 Grenoble et al.
5,496,464 A 3/1996 Piskorz et al.
5,502,262 A 3/1996 Yamasaki et al.
5,565,616 A 10/1996 Li et al.
5,578,647 A 11/1996 Li et al.
5,725,756 A 3/1998 Subramanian et al.
5,785,868 A 7/1998 Li et al.
5,888,389 A 3/1999 Griffith et al.
5,914,031 A 6/1999 Sentagnes et al.
6,123,835 A 9/2000 Ackerson
6,428,686 B1 8/2002 Ackerson

STAGED HYDROCARBON CONVERSION PROCESS

CROSS-REFERENCE TO RELATED APPLICATIONS

This application is a continuation-in-part of application having Ser. No. 11/634,297, filed on Dec. 5, 2006, now abandoned which is a continuation of U.S. Pat. No. 7,144,498 having Ser. No. 10/707,997, filed on Jan. 30, 2004, which are both incorporated by reference herein.

BACKGROUND

1. Field

The present embodiments generally relate to gasifying hydrocarbons. More particularly, embodiments relate to staging an investment for a hydrocarbon gasification system and process.

2. Description of the Related Art

Processes for converting high boiling point heavy hydrocarbons to lower boiling point hydrocarbons have traditionally been used to provide one or more easily transportable products. Traditionally, these conversion processes require both a local infrastructure, including utilities such as water, electric, and natural gas to upgrade the hydrocarbons, and a transportation infrastructure to support the shipment of upgraded hydrocarbons. While hydrocarbon cracking and other similar conversion processes are well suited for developed, on-shore, installations, the necessary infrastructure to support large-scale, integrated, conversion facilities may not be available in the more remote on-shore, and in most off-shore locations.

The ability to upgrade heavy hydrocarbons close to the point of extraction prior to transport to more extensive refining facilities is essential for the economic development of remote production fields. Local conversion and gasification of the heavy hydrocarbons at or near the point of extraction can facilitate an energy source for steam generation providing the capability to economically develop remote hydrocarbon production fields. Even greater economic efficiency can be obtained if such gasification operations can employ equipment amenable to the later installation of the full conversion process.

A need exists for an operating mode that minimizes initial capital costs while providing the capability of gasifying hydrocarbon feedstocks for energy production during initial phases of the project.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
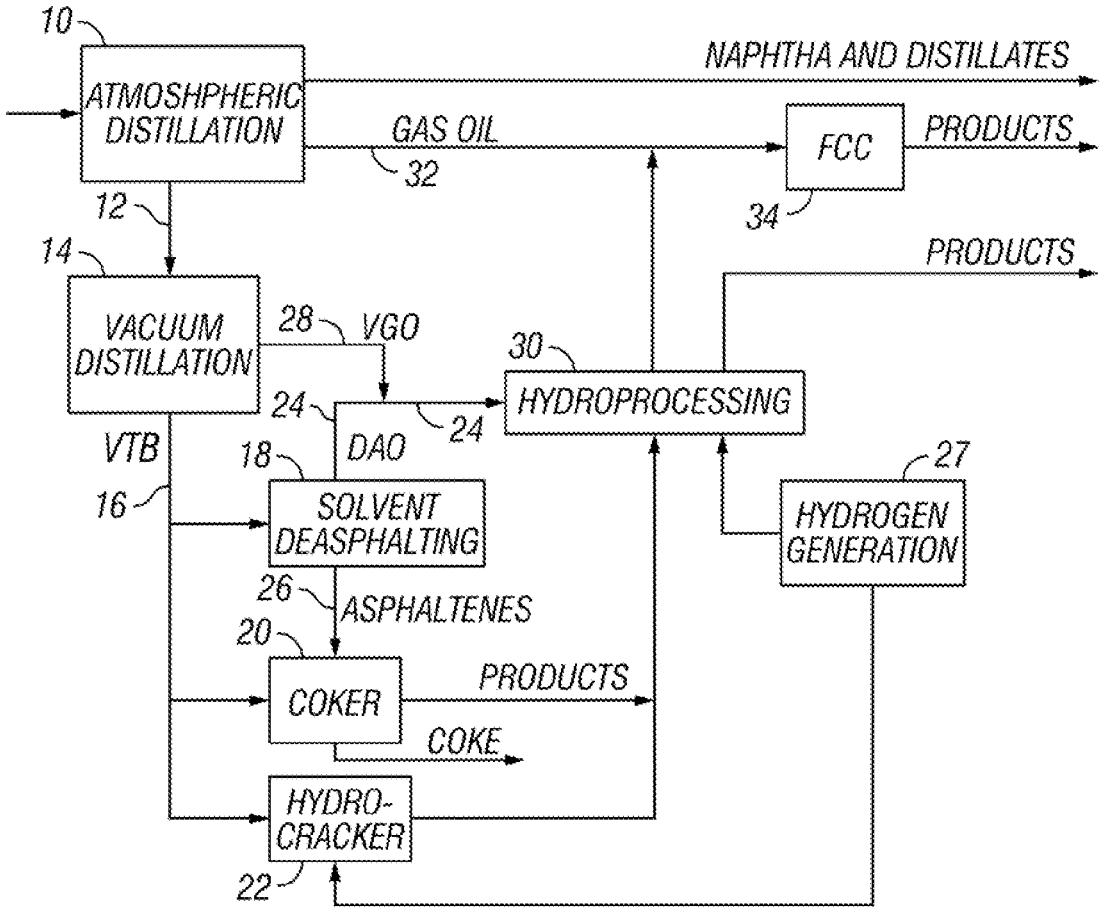
FIG. 1 (Prior Art)
FIG. 1 depicts a simplified schematic diagram of a typical refinery configuration.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

The present invention addresses the processing of petroleum and hydrocarbons from other feedstock sources, desirably its fractions and similar materials containing hydrocarbons having boiling points greater than 538° C. (1000° F.), using supercritical conversion with a hydrocarbon or mixture of hydrocarbons as the solvating medium for the high boiling hydrocarbon feed. The conversion occurs in a reaction zone at a temperature above the critical temperature of the hydrocarbon feedstock-solvent mixture, which can be estimated by employing conventional equation of state calculations. The desired reaction temperature can be achieved by simultaneously introducing the solvent-feed mixture and the hot particulates into the reaction zone, wherein the feedstock-solvent mixture is preheated to a temperature below the desired reaction temperature to avoid premature coking, and the hot particulates initially are at a temperature considerably above the desired reaction temperature, such that the resulting reaction mixture has a thermal equilibrium at the desired reaction temperature.

The reaction zone pressure is desirably maintained between 4.8 to 13.8 MPa (715 to 2015 psia), more desirably between 5.5 to 12.4 MPa (815 to 1815 psia), and even more desirably between 8.3 to 11.0 MPa (1215 to 1615 psia). The temperature is desirably maintained between 371° to 593° C. (700° to 1100° F.), and more desirably between 440° to 524° C. (825° to 975° F.). It is very important that the critical pressure and temperature of the mixture are achieved, rather than just the critical temperature and pressure of the solvating hydrocarbons.

The solvating hydrocarbon-feedstock mixture is desirably present in a single phase. The conversion at conditions within the retrograde regime of the fluid phase can lead to increased coke production. Higher conversion temperatures tend to facilitate the conversion to lower molecular weight products due to kinetic effects, but considerably higher temperatures lead to reduced selectivity and produce more gaseous hydrocarbons and/or light ends. Some material from the high boiling hydrocarbon feedstock may remain in solid form deposited on the original circulating solids. These deposited solids can recirculate with the hot particulate solids during regeneration, will build up on the circulating solids and may be purged periodically along with a purge stream of particulate solids.

As used herein, the term "high-boiling hydrocarbons" is used to refer to hydrocarbons with a normal boiling point above 538° C. (1000° F.). High-boiling hydrocarbons can be present in a variety of materials, including but not limited to: crude oil, atmospheric tower bottoms, vacuum tower bottoms, deasphalted oils, visbreaker tars, hydrotreater bottoms, resid hydrotreater bottoms, hydrocracker resid and gas oils, coker gas oils, asphaltenes, FCC slurry oils, bitumens, tar sand bitumens (including inherent inert matter such as sand), naturally occurring heavy oils, combinations thereof and the like. When used in reference to a source material, the term "high-boiling hydrocarbons" is intended to refer to the fraction of the source material hydrocarbons boiling above 538° C. (1000° F.). Some of the source material can contain some fractions boiling below 538° C. (1000° F.), as well as some fraction of material that is insoluble in hydrocarbon solvents.

The processing can be used in conjunction with the vacuum tower, solvent deasphalting, coker (delayed coker, fluid coker, and/or Flexicoker), visbreaker, hydrocracker, resid hydrotreater, hydrotreater, and/or FCC; or it can desirably be used to replace any or all of these units and/or to reduce the load on such units. This invention is particularly attractive for treating high-boiling hydrocarbons in the form of, or obtained from, source materials having an API gravity less than 25 and Conradson Carbon Residue (CCR) greater than 0.1 weight percent. The conversion is desirably effected in the presence of a major portion of a solvating hydrocarbon, with heating supplied by hot solid particles, at carefully selected supercritical mixture conditions to convert the high boiling hydrocarbons to lower boiling hydrocarbons with good selectivity to naphtha, distillates, and gas oils while having low gas production and coke formation, and reducing or desirably essentially eliminating Conradson Carbon Residue (CCR). In addition, sulfur, nitrogen and organo-metallic compounds are reduced in the converted hydrocarbon liquid products.

The solvating hydrocarbons initially added to the feedstock, if necessary, are desirably aliphatic, cycloaliphatic, or aromatic hydrocarbons, or mixtures thereof. Desirably, the solvating hydrocarbons are a mixture of hydrocarbons defined by a boiling point range. As used herein, "solvating hydrocarbon" is used to refer to any hydrocarbon with a normal boiling point less than 538° C. (1000° F.), desirably less than 316° C. (600° F.). Some of the solvating hydrocarbons converts to lower-boiling hydrocarbons during the conversion of the high boiling hydrocarbons, especially when gas oils are present as solvating hydrocarbons, but such solvent conversion can be less pronounced for lower molecular weight hydrocarbons such as distillates, and minimal in the case of naphtha, present in the feedstock and solvating hydrocarbons mixture. Gas condensate with a boiling range of 27° to 121° C. (80° to 250° F.), or naphtha can be conveniently used as solvents, desirably light naphtha with a boiling range of 32° to 82° C. (90° to 180° F.), or heavy naphtha with a boiling range of 82° to 221° C. (180° to 430° F.).

Hydrocarbons recycled from the converted product can be used as solvating hydrocarbons and can be recycled from the product stream to the mixing step for mixing with the feedstock containing the high boiling hydrocarbons. At steady state, the solvating hydrocarbon can be conveniently obtained by flashing and/or distillation operations carried out with the product solution or a portion thereof. Examples of hydrocarbons obtained from the conversion process suitable as solvating hydrocarbons include, but are not limited to, light, heavy and full-range naphthas, distillates, and gas oils.

Normally, from an economic standpoint, it is desirable to minimize the cost of solvating hydrocarbons, especially where the solvent is imported into the process. In the present invention, however, the solvating hydrocarbons can be produced in excess of what is required for recycle to the conversion of the feedstock. If the solvent to feed ratio is too low, it can be difficult to simultaneously maintain supercritical reactor conditions and suitable reaction pressures and temperatures, and decreased conversion and/or excessive coke make with reactor fouling or plugging can result. The solvating hydrocarbons should desirably comprise a major portion of the feedstock-solvating hydrocarbon mixture, i.e. at a weight ratio of solvating hydrocarbon to high-boiling hydrocarbons of at least 2:1. Suitable feedstock-solvent mixtures can be obtained by mixing the feed source containing the high boiling hydrocarbons with additional solvent at a weight ratio of solvent:feed source from 2:1 to 10:1 or more, more desirably from 3:1 to 6:1. The exact ratio of solvent to feedstock that is desired depends upon a number of factors, especially the critical temperature of both the high boiling hydrocarbons and the solvating hydrocarbons. Because the high boiling hydrocarbons generally have high critical temperatures, it is necessary to combine them with a sufficient amount of solvating hydrocarbons having lower critical temperatures, thus resulting in a manageable critical temperature for the feedstock-solvating hydrocarbon mixture. Desirably, the mixture has a critical temperature between 204° to 538° C. (400° to 1000° F.), more desirably between 316° to 524° C. (600° to 975° F.).

In the various embodiments of the invention, the solid particulate material can be any material that provides a surface upon which to deposit coke, such as, for example, beach sand, the sand or other solids that occur in the production of naturally occurring bitumens or tar sands, glass beads, or the like. The solid particulate material desirably comprises a refractory oxide, such as, for example, SiO2, Al2O3, AlPO 4, TiO2, ZrO2, Cr2O3, or the like, and mixtures or combinations thereof. The solids can be similar to the matrix (sans catalyst) produced for catalysts used in fluid catalytic cracking (FCC) and/or hydrotreating (HT) processes, or it can include spent FCC and/or HT catalyst from such a process. These matrix materials are used to support the transition metal catalysts used in processes such as hydrocarbon reforming, alkylation, isomerization, hydrotreating, cracking, hydrocracking, fluid catalytic cracking, hydrogenation, dehydrogenation, hydrodesulfurization, hydrodenitrogenation, hydrodemetallization, and the like. In certain embodiments of the present invention, coke may rapidly deposit on the surfaces of the solids in the reaction zone and may not be completely removed during regeneration, so that the presence of transition metal catalyst thus only has a transitory or no appreciable effect on the reactions in the reaction zone. Therefore, conventional spent FCC/HT catalytic materials can be employed in the process, where these are readily available at a lower cost than other suitable particulate solids. Although new FCC/HT catalytic materials could also be used, there will generally be no economic advantage to be realized because of their high cost.

The solids desirably have a particle size distribution of substantially between 25 and 350 microns, more desirably having an average particle size of approximately 100 microns, facilitating fluidization in a transport reactor. As used herein, the term "fluidized" refers to a gas-solid contacting process in which a bed of finely divided solid particles is lifted and agitated by a stream of gas. At low velocity, the solid particles remain in a zone called a "bubbling bed" and only a small fraction of the particles are conveyed out of such a zone. At high velocities the solid particles are carried along with the gas in what is referred to as a "transport hydrodynamic regime." In terms of the present invention, the fluidized solids result in residence times of the solids, solvating hydrocarbons, and feedstock materials in the reaction zone of less than 60 seconds, desirably less than 30 seconds, more desirably between 10 and 15 seconds. Desirably, the solids in the reaction zone and the regeneration zone are maintained in the fluidized and/or transport hydrodynamic regime.

The solids and hydrocarbon feedstock desirably mix in a mixing zone before entering a transport zone consisting of a riser. The solids and hydrocarbon feedstock-solvent mixture can desirably flow through the riser of the transport reactor at a rate of at least 1.2 meters/sec (4 ft/sec), more desirably at a rate of at least 2.1 meters/sec (7 ft/sec). This velocity is sufficient to transport any solids suspended within the hydrocarbon feedstock and/or solvating hydrocarbon, along with the particulate solid, to the regeneration zone. Movement of the solids present, including non-vaporized hydrocarbons and particulate solids, prevents the buildup of materials in the reactor.

The use of the transport reactor and circulating solids generally results in reduced coke formation. In prior art cracking reactors, coke formation has been a persistent problem, leading to undesirable byproducts, reactor and equipment fouling and plugging, and catalyst deactivation. Deactivation is particularly troublesome as regeneration and/or removal of the catalyst prohibits the continuous running of the process. Deactivation in the present invention is immaterial because the reaction does not rely on a transition metal catalyst.

Molecular hydrogen can optionally be added to the conversion zone, and can be added to the feedstock mixture, desirably from 18 to 1800 standard cubic meters per cubic meter (100 to 10,000 standard cubic feet per 42-gallon barrel (SCFB)) of the high-boiling hydrocarbons feed, more desirably between 36 to 900 standard cubic meters per cubic meter (200 and 5000 SCFB) of the high-boiling hydrocarbons feed, and especially up to the solubility limit of hydrogen in the feedstock-solvating hydrocarbon mixture at the supercritical temperature and pressure of the mixture. The addition of hydrogen can in some cases increase the conversion of hydrocarbons boiling above 538° C. (1000° F.), and remove sulfur and nitrogen through the formation of H2S and ammonia, while at the same time leading to decreased production of coke.

Coking is thought to result from overcracking and polymerization of coke precursors at the particulate surface. The coke deposited on the solids or otherwise formed in the reaction zone will be associated with or deposited on the particulate solids and will serve as a fuel source to regenerate and re-heat the solids by coke combustion for re-introduction to the reactor riser. The present use of the transport reactor, more specifically the regeneration and recirculation of the solid materials, facilitates continuous running of the conversion process for extended periods of time. Coke formed during the conversion process is advantageously used as a fuel to supply the heat to the circulating particulate solids during the regeneration process as needed to rapidly heat the feedstock mixture to reaction temperature. A portion of the solids, e.g. attrited fines, can, however, be withdrawn from the transport reactor, either periodically or continuously, and replaced with fresh solids as is necessary. For example, fines can be continuously removed with the regeneration off gas as a result of inherently incomplete cyclonic solids removal from the regenerator riser effluent, while the feedstock may contain additional solid particles. Alternatively, solids can be removed and added separately.

Regeneration of the solids takes place in the regeneration reactor where the solid particulates containing the deposited coke are mixed with sufficient quantities of steam and oxygen, to achieve partial oxidation of the coke and regeneration of the solids, raising the temperature of the solids to approximately 760° C. (1400° F.), and producing a low heating value gas stream. Desirably, the regeneration zone is maintained at a temperature range of between approximately 593° to 1316° C. (1100° to 2400° F.), and at a pressure of within 0.5 MPa (73 psi) of the pressure maintained within the conversion zone. For safety reasons, the steam/oxygen ratio is desirably equal parts of steam and oxygen on a weight basis. Alternatively, the combustion effected in the regeneration reactor takes place with the addition of an oxygen containing gas, without the presence of steam. The combustion can take place with an excess of oxygen, resulting in a CO free offgas, or with a substoichiometric amount of oxygen resulting in the production of a CO-containing offgas. In either case, if the coke recovered with the spent solids is insufficient to heat the solids during regeneration to maintain the reaction zone temperature, additional fuel such as gas or oil can be supplied to the regeneration. The regeneration riser desirably has a velocity of at least 0.3 meters/sec (1 ft/sec), and more desirably at least 1.2 meters/sec (4 ft/sec), resulting in a residence time of the solids in the regenerator of between 10 and 60 seconds.

The conversion product effluent comprises converted high boiling hydrocarbons, as well as solvating hydrocarbons initially present in the feedstock mixture. The conversion product effluent is desirably a mixture of hydrocarbon compounds having a normal boiling point of less than 538° C. (1000° F.), desirably less than 316° C. (600° F.), and even more desirably less than 221° C. (430° F.). A portion of the product effluent can be separated by conventional means to be recycled to the mixing step as the solvating hydrocarbon, as described above. If desired, distillation processes can be employed to isolate specific hydrocarbons or isomers, for example pentanes, hexanes, toluene, etc.

Where the high-boiling hydrocarbons contain Conradson Carbon Residue (CCR), sulfur compounds, nitrogen compounds, and organometallic compounds, the content thereof in the converted product is reduced relative to that of the feed. Typical petroleum residues can contain 0.1 to 8 weight percent sulfur, 0.05 to 3 weight percent nitrogen, up to 3000 ppmw metals, have a CCR from 0.1 to 30 weight percent or more, more typically a CCR from 2 to 25 weight percent. Desirably, the product has at least 80 percent less hydrocarbons boiling above 538° C. (1000° F.), at least 40 percent less CCR, at least 30 percent less sulfur, at least 30 percent less nitrogen, and at least 30 percent less metal; more desirably there is 90 percent conversion or removal of the hydrocarbons boiling above 538° C. (1000° F.), at least 80 percent less CCR, nitrogen, and metals, and at least 40 percent removal of sulfur; especially that there is essentially complete conversion or removal of the hydrocarbons boiling above 538° C. (1000° F.), CCR and metals, and at least 50 percent removal of sulfur and nitrogen.

Naphthas, distillates and gas oils can be further processed to yield more useful hydrocarbons. Naphtha is mainly used for motor gasoline and processed further for octane improvement by catalytic reforming. Distillate is used to produce diesel, jet fuels, kerosene and certain specialty solvents. Gas oils are normally used as feeds to catalytic cracking or hydrocracking.

The converted hydrocarbon product of the invention can be further used in a variety of processes aimed at end products such as the production of fuels, olefins, petrochemical feedstocks and other petroleum products. For example, naphtha recovered directly from petroleum crude is too low in octane (30 to 50 octane) to meet quality requirements for motor gasoline. Naphtha boiling in the range of between 82° and 221° C. (180° to 430° F.) can be upgraded by catalytic reforming for use as a fuel. The effluent produced by the supercritical conversion unit can be collected as product, recycled as solvating hydrocarbons to the feedstock mixing step, or further processed by conventional methods. For example, naphtha can be collected as product, recycled for use as a solvating hydrocarbon, or further processed in a conventional naphtha treatment process to yield gasoline. Similarly, distillates can be further processed to yield kerosene and diesel.

Hydroprocessing is another process used to improve the quality of the product. Mild hydrotreating removes sulfur, nitrogen, oxygen and metals, and hydrogenates olefins. In a typical hydrotreatment process, a solids-free hydrocarbon is introduced with molecular hydrogen into a hydrotreatment zone containing a hydrotreatment catalyst. The conversion effluent introduced to the hydrotreatment process should be free of solids to prevent plugging and contamination of the hydrotreatment catalyst. If necessary, filters can be employed to further ensure the conversion effluent is free of solids. Desirably, the reaction zone of the hydrotreatment process is maintained at a temperature and pressure whereby the effluent is present as a single phase. More desirably, the hydrotreatment zone is maintained above the supercritical temperature and pressure of the effluent.

The product of the hydrotreatment process contains less nitrogen, sulfur, and heavy metals relative to the effluent feed. Desirably, the product of the hydrotreatment process will contain essentially no heavy metals and very low levels of sulfur and nitrogen. A portion of the product can be recycled as solvating hydrocarbons to the feedstock mixing step, or it can be further processed and/or separated as desired.

Catalytic cracking converts heavy distillate oil to lower molecular weight compounds in the boiling range of gasoline and middle distillate. The process is most often carried out in a fluidized-bed process where small particles of catalyst are suspended in upflowing gas. The lower molecular weight products can be further processed as necessary.

Figure 2:
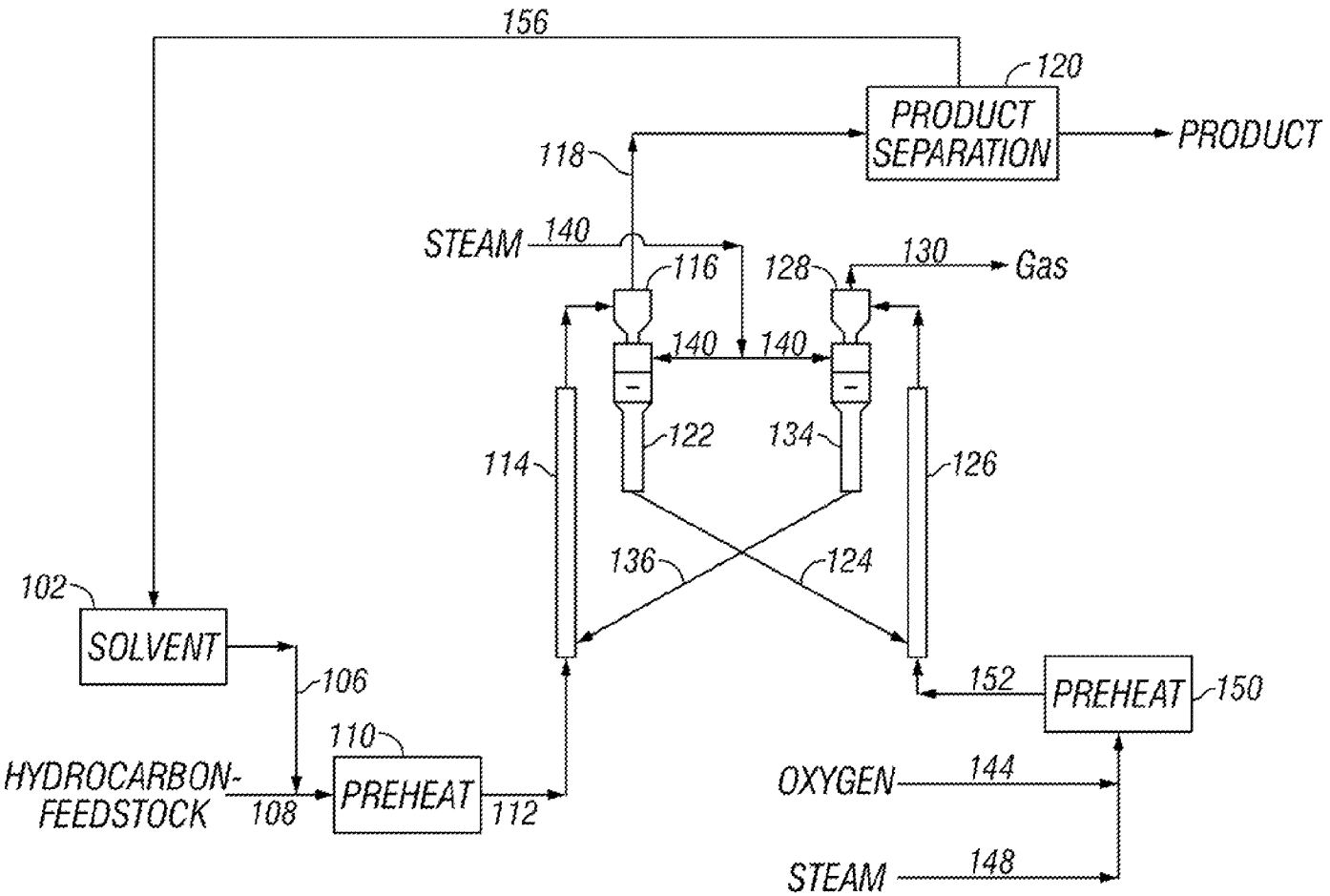
FIG. 2 is a simplified schematic diagram of the components of a refinery configuration where crude oil is processed in a supercritical conversion unit according to one or more embodiments described.

FIG. 2 represents one embodiment of the invention wherein the high boiling hydrocarbons in a feedstock are converted under supercritical conditions. Solvent 102 via line 106 is mixed with hydrocarbon feedstock via line 108, and the mixture is then fed to preheater 110 where the solvent-feedstock mixture is preheated to a temperature as high as possible without forming coke in the preheating unit. The preheated feedstock mixture is introduced into the riser 114 via line 112, where it is mixed with the hot solid particulates in a mixing zone. The solids entering the mixing zone have a temperature above that of the feedstock mixture and the reaction zone, to supply sufficient heat to heat the feedstock mixture to reaction temperature and to also supply the heat for the generally endothermic conversion of the high-boiling hydrocarbons.

The converted hydrocarbon effluent is separated from the solids via disengager/cyclone 116 and enters line 118. The effluent 118 is introduced to a product separation step 120 employing traditional separation means, producing converted hydrocarbon product stream 154 and recycled solvent stream 156, which can optionally be recycled via line 106 as mentioned above, or further processed as desired.

The solids separated by disengager/cyclone 116 enter stripper 122. The solids from stripper 122 enter regeneration riser 126 via cross over 124. Steam is introduced to stripper 122 via header 140. Oxygen, from a standard air separation unit, optionally together with steam, is introduced to preheater 150 via lines 144 and 148 respectively. The preheated oxygen/steam mixture is introduced into regeneration riser 126 via line 152, where it is combined with particulate solids containing coke and any residual hydrocarbons to produce a low heating value gas stream. The solids desirably have a velocity in the regeneration riser 126 of between 0.5 and 2 meters/sec (1.6 to 6.5 ft/sec), desirably resulting in residence times of between 10 and 40 seconds. The regenerated solids and any associated gas produced exit regeneration riser 126 and enter disengager/cyclone 128 where the solids and gases are separated. The low heating value gas exits via line 130 for further collection or processing via conventional methods. The regenerated solids enter stripper 134 where they are contacted with steam introduced via header 140. The regenerated solids are recirculated to reactor riser 114 via cross over 136.

Figure 3:
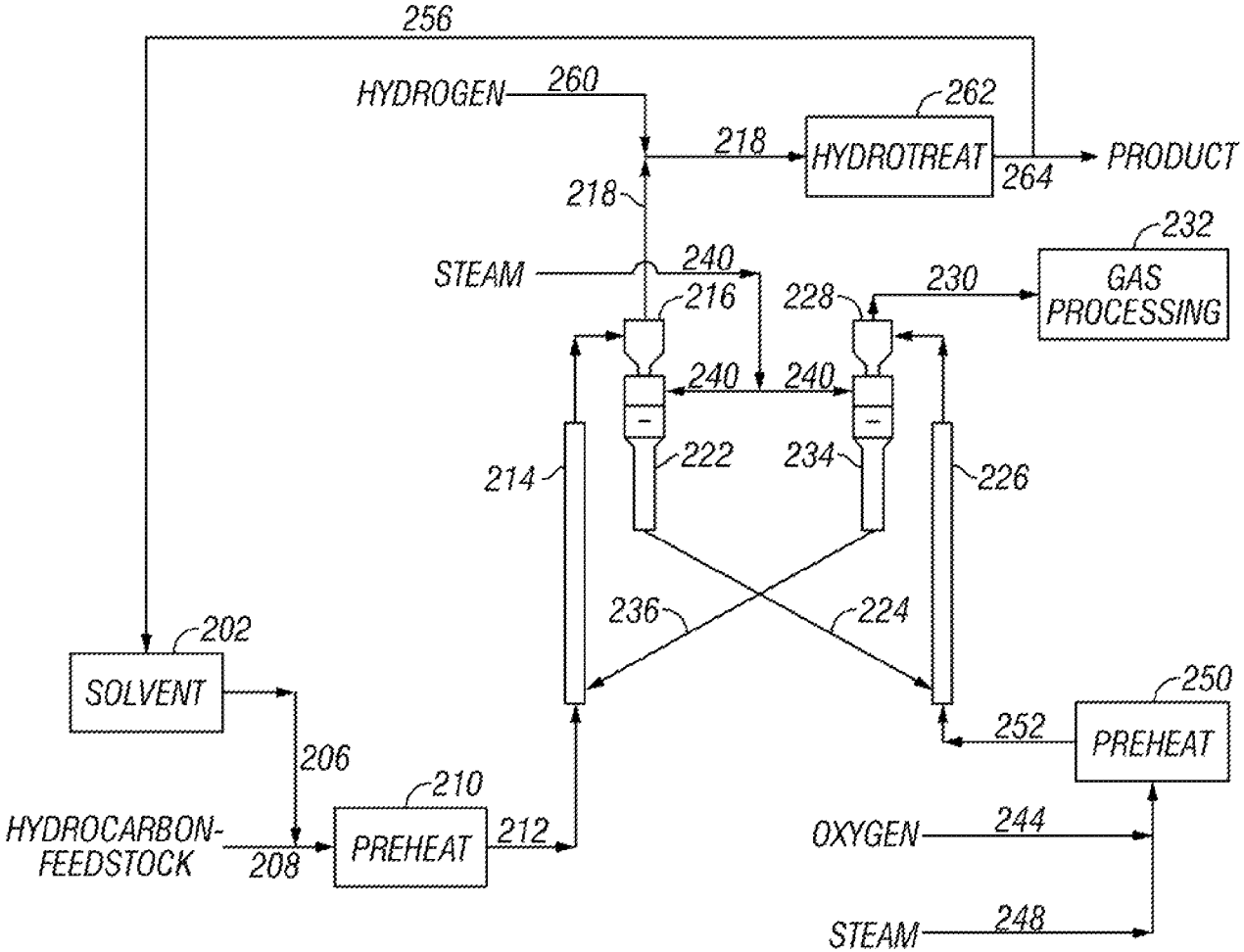
FIG. 3 depicts a simplified schematic diagram of a refinery configuration where crude oil is processed in a supercritical conversion unit, and further processed in a hydrotreating reactor, according to one or more embodiments described.

Referring now to FIG. 3, there is represented an embodiment of the invention wherein the feedstock is first converted under supercritical conditions, and then further processed in a hydrotreating reactor. Solvent 202 and the high boiling hydrocarbon feedstock are mixed and added to preheater 210 via lines 206 and 208, respectively. The preheated feed mixture enters the riser 214 of a transport reactor via line 212, where it comes into contact with hot particulate solids. Upon contacting the hot particulate solids, the feed mixture achieves a supercritical reaction temperature.

The gaseous converted hydrocarbon effluent is separated from the solids by disengager/cyclone 216, and enters line 218. If necessary, residual solids are removed from the effluent prior to hydrotreating, e.g. by filtration, electrostatic precipitation, liquid contact, or the like. Hydrogen-containing gas enters line 218 via line 260, and is mixed with the converted hydrocarbon effluent. The amount of hydrogen used desirably does not exceed the hydrogen saturation point so that true single-phase conditions are maintained. The hydrogen-rich mixture enters hydrotreating reactor 262 where it contacts a conventional hydrotreating catalyst to produce a hydrotreated hydrocarbon effluent 264. The hydrotreating reactor is also desirably maintained at conditions above the supercritical temperature and supercritical pressure of the feed to the hydrotreating reactor. The hydrotreated effluent can be separated by conventional means into solvent 256 and one or more product streams. The solvent can be recycled with the hydrocarbon feedstock to the transport reactor, as previously mentioned.

The solids separated by disengager/cyclone 216 enter stripper 222, are treated with steam prior to entering regeneration riser 226 via reactor cross over 224. Steam enters strippers 222 and 234 via header 240. Oxygen, and optionally steam, is introduced to preheater 250 via lines 244 and 248 respectively. The preheated gas is introduced into regeneration riser 226 via line 252, where coke combustion and solids regeneration occur. The regenerated solids and associated gas enter disengager/cyclone 228 where the solids and gas are separated. Low heating value gas exits via line 230 for further collection or gas processing 232. The regenerated solids enter stripper 234, and are recirculated to reactor riser 214 via regenerator cross over 236.

Figure 4:
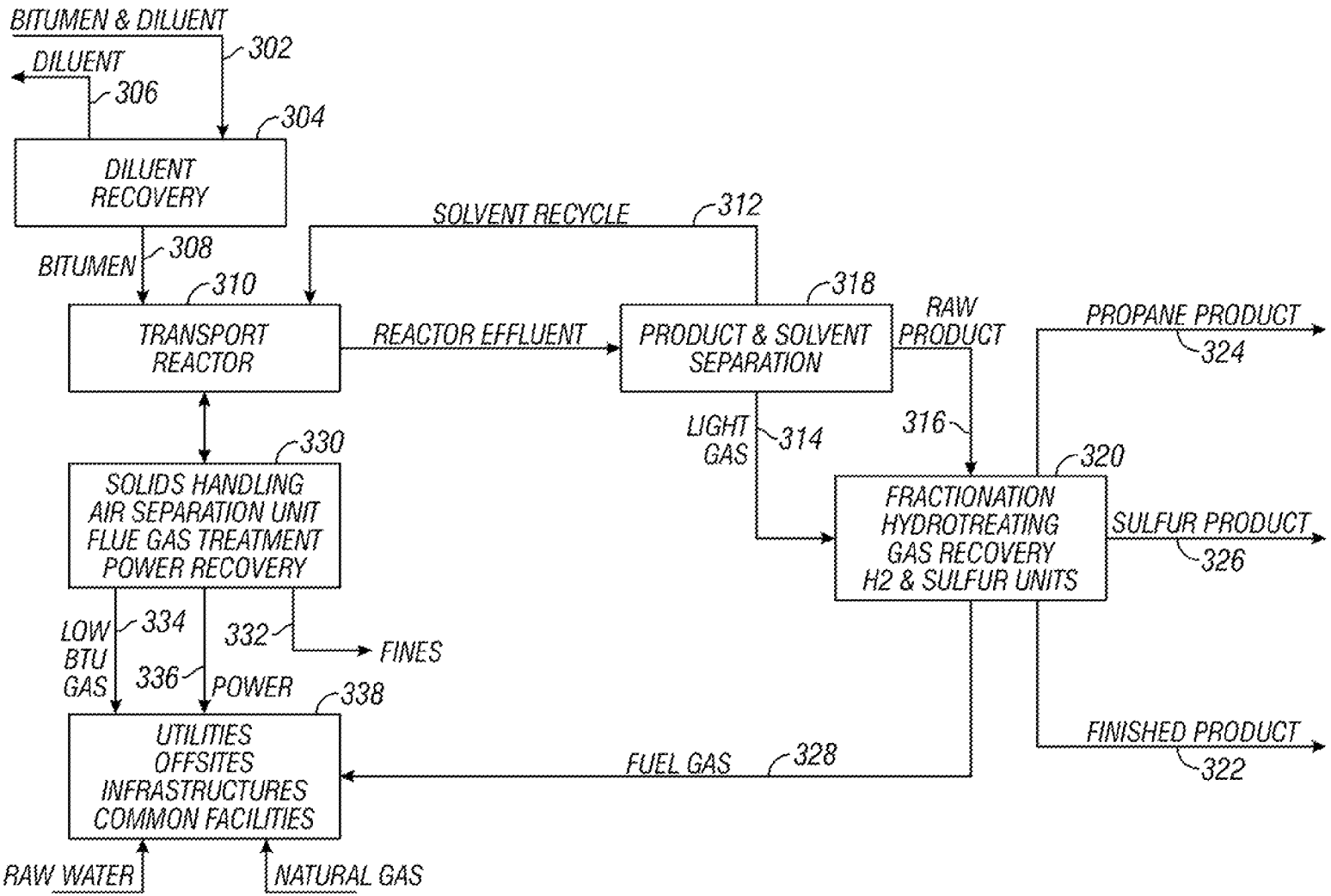
FIG. 4 depicts a simplified schematic diagram for processing bitumen pipelined with a separate upstream diluent, according to one or more embodiments described.

FIG. 4 shows an application of the process of FIG. 2 in a bitumen processing scheme wherein a conventional hydrocarbon diluent is used to pipeline the bitumen from a production site, for example. The pipeline mixture 302 is supplied to conventional diluent recovery unit 304 to remove diluent, which is returned to the pipeline source via line 306. The recovered bitumen 308 is supplied to transport reactor unit 310 configured like transport reactor 114 shown in FIG. 2, along with solvent recycle 312. The solvent recycle 312 and light gas 314 are separated from raw product 316 in product-solvent separation unit 318. The light gas 314 and raw product 316 are fed to processing unit 320 for fractionation, hydrotreating, gas recovery, hydrogen recovery and/or sulfur recovery, as desired, to obtain finished product stream 322 suitable for pipelining as a synthetic crude oil to a refinery or other destination, as well as propane product 324, sulfur product 326 and fuel gas 328. Reactor auxiliaries unit 330 includes a solids handling system for supplying makeup solids to the reactor unit 310 and processing spent solids and fines 332, an air separation unit for supplying regeneration oxygen, flue gas treatment for the regeneration off gas to obtain a low heating value fuel gas 334, and/or a power recovery station including a turbine or other work recovery device to recover power 336 from flue gas or process fluid expansion. Fuel gas 328, fuel gas 334, and power 336 can be supplied to common facilities unit 338 along with water and natural gas as needed for offsites and utilities, including process steam generation for the transport reactor unit 310.

Figure 5:
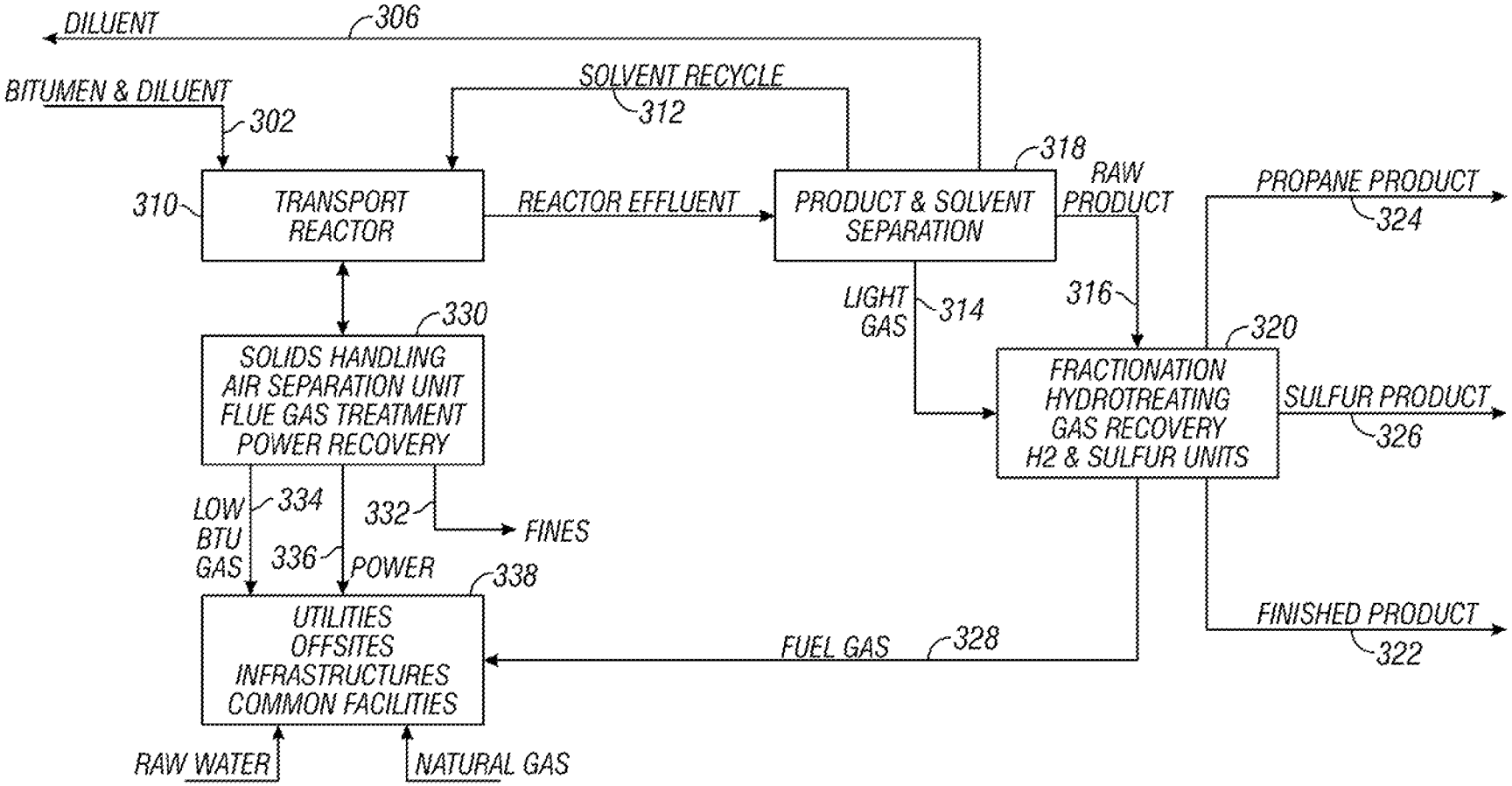
FIG. 5 depicts a simplified schematic diagram for processing bitumen pipelined with an upstream diluent used as a solvent in a transport reactor according to one or more embodiments described.

The arrangement of FIG. 5 is similar to that of FIG. 4 except that the bitumen-diluent pipeline mixture 302 is supplied as the feedstock directly to the transport reactor unit 310 without prior diluent removal. The diluent functions as a solvent in this case and additional solvent recycle 312 is supplied only as necessary to obtain the desired solvent:high-boiling hydrocarbon ratio. The diluent return 306 in this case, which can be the same as the recycle solvent or different, is obtained from the product-solvent separation unit 318.

Figure 6:
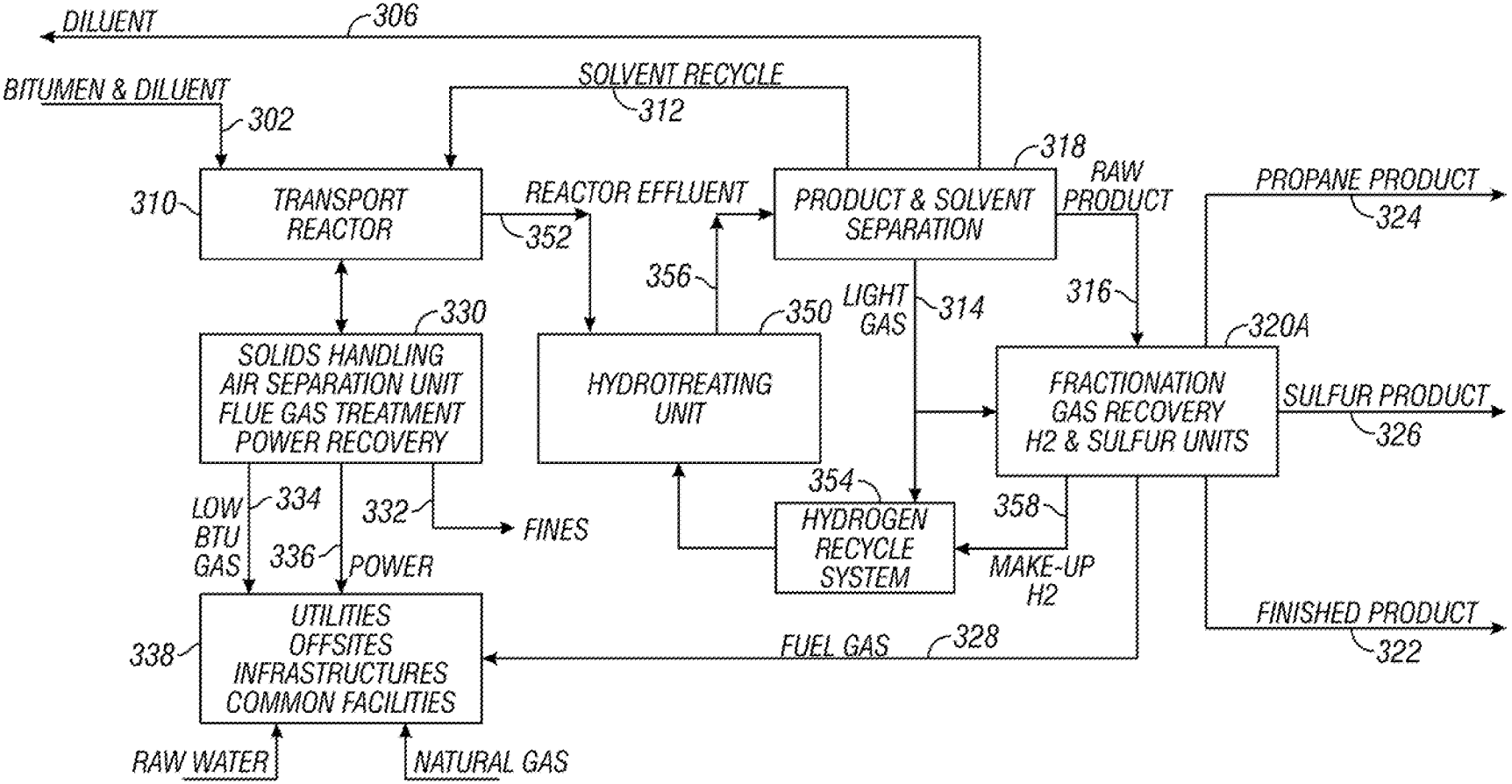
FIG. 6 depicts a simplified schematic diagram for processing bitumen pipelined with an upstream diluent used as a common solvent in a transport reactor and hydrogenation reactor in series according to one or more embodiments described.

The arrangement of FIG. 6 is similar to that of FIG. 5, but includes an integrated hydrotreating unit 350 configured with the transport reactor unit 310 as in the FIG. 3 process. The solids-free transport reactor effluent 352 containing both solvent and converted hydrocarbons is supplied directly to the hydrogenation unit 350 along with makeup hydrogen from hydrogen recycle system 354. The hydrogenated effluent 356 is then supplied to product-solvent separation unit 318. The processing unit 320A, which would no longer include the hydrotreating or all of the fractionation processing of processing unit 320 of FIGS. 4-5, can supply make-up hydrogen 358 to hydrogen recycle system 354. If desired, all or part of light gas 314 can have a sufficient hydrogen content to be used as an additional and/or alternative source of hydrogen to unit 350.

The invention is illustrated by way of the non-limiting examples which follow.

Figure 7:
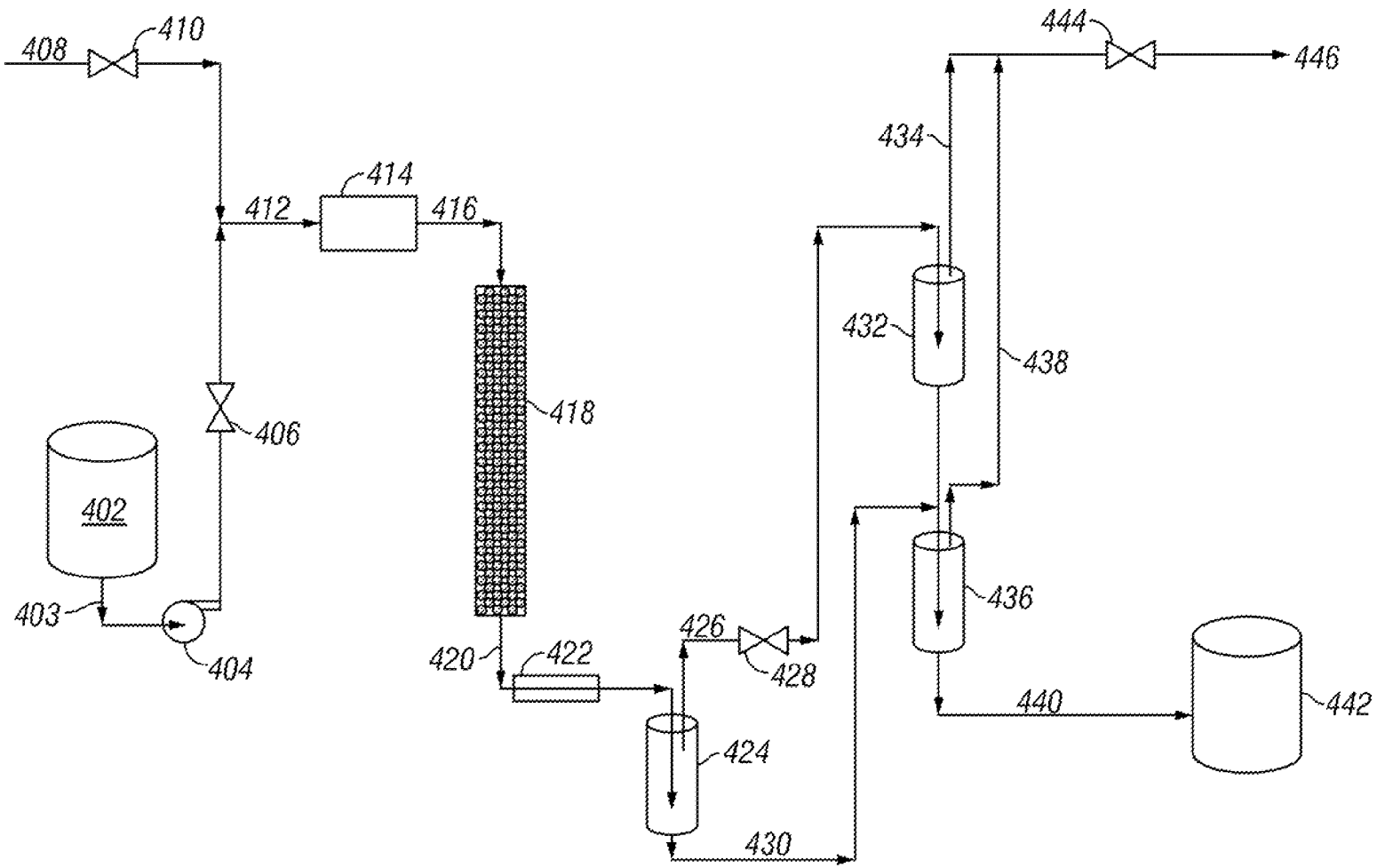
FIG. 7 depicts a schematic of an experimental apparatus used in the examples.

EXPERIMENTAL APPARATUS: The experimental bench scale apparatus shown in FIG. 7 was used to process a feedstock comprising a portion boiling above 538° C. (1000° F.) over a fixed bed reactor to simulate the reaction conditions of the present invention. A hydrocarbon solvent and high boiling hydrocarbon source were introduced to the system from feedstock reservoir 402 via line 403, introduced via pump 404 and metered by control valve 406. The feedstock was mixed with molecular hydrogen, or an inert gas such as helium, introduced via line 408, and metered through valve 410. The feedstock-gas mixture was introduced to preheater 414 via line 412. The preheated mixture was then pumped via line 416 to fixed bed reactor 418 where the heavy hydrocarbons were converted to hydrocarbons having boiling points less than 538° C. (1000° F.). The converted hydrocarbons exited the reactor via line 420 and entered cooler 422 before the cooled product entered primary flash tank 424 where the effluent was separated into a gas and liquid phase. The liquid phase exits the primary flash tank 424 via 430 and enters liquid flash tank 436. The gas phase exited the primary flash tank via 426, was metered via valve 428, and entered a secondary flash tank 432, where further separation occurred. The liquid phase from secondary flash tank 432 combined with the liquid phase from primary flash tank 424 in liquid flash tank 436, exiting via line 440 and collected as product 442. The gas phase from secondary flash tank 432 was discharged via line 434, combined with the gas phase exiting liquid flash tank 436 via line 438, and metered via valve 444 into line 446 for further analysis.

Figure 8:
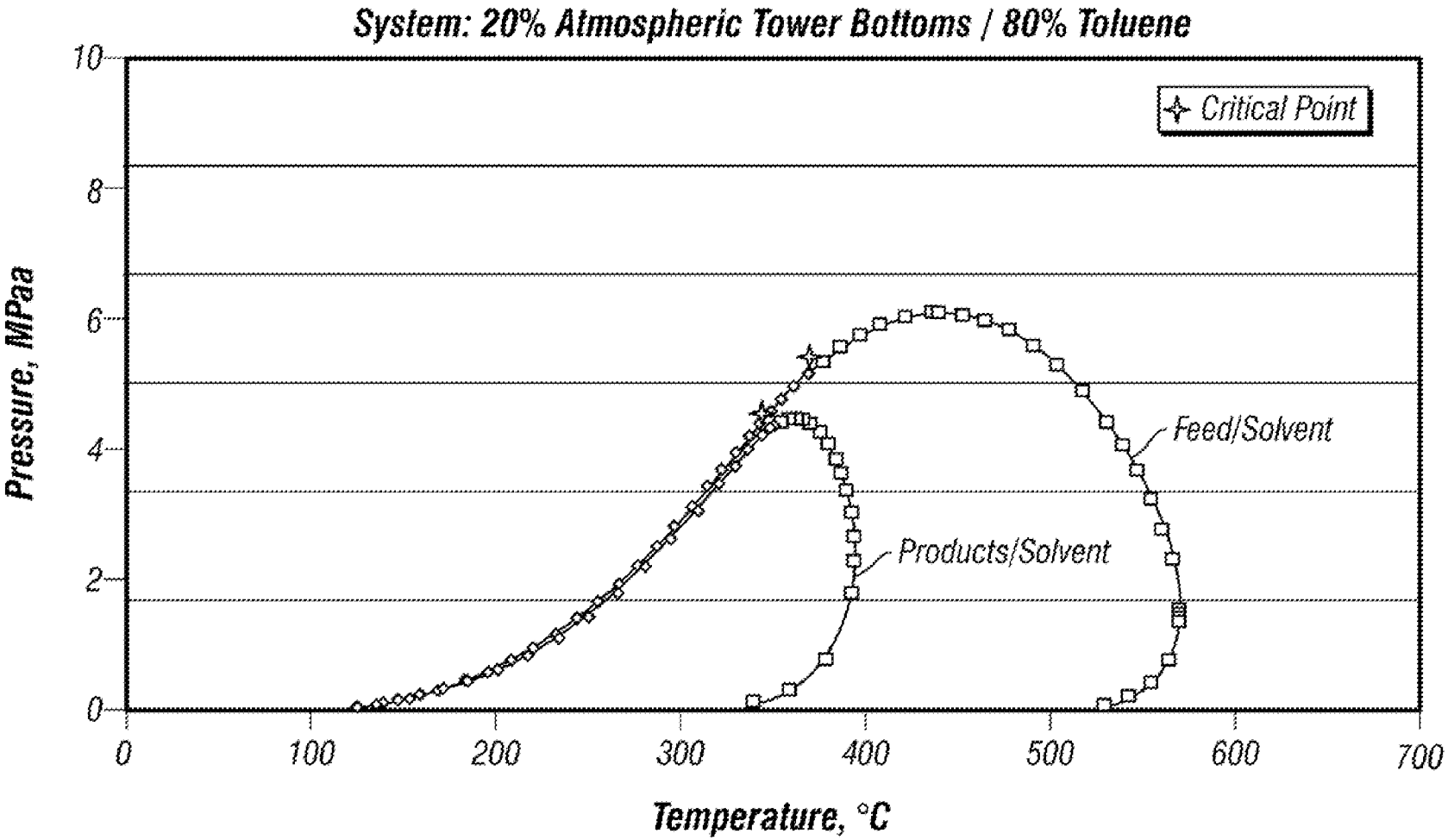
FIG. 8 depicts a typical pressure-temperature phase diagram for a feed system and products of a supercritical conversion process according to one or more embodiments described using atmospheric tower bottoms as feed and 80 weight percent toluene as solvent.

ATB:TOLUENE (1:4): The FIG. 7 apparatus was used with an alumina bed to treat a feedstock mixture comprising 20 weight percent ATB and 80 weight percent toluene at 454° C. (850° F.) and 10.1 MPa (1465 psia). FIG. 8 shows a calculated pressure-temperature diagram for the saturated 20% ATB-80% toluene feed system and the reactor effluent product-solvent system collected from the reactor. The feed mixture has a substantially higher pressure-temperature curve (above and to the right) than the product curve (below and to the left). The critical points (*) on the curves in FIG. 8 indicate the product mixture has a lower supercritical pressure and temperature relative to the feed mixture. The supercritical conversion in the present invention occurs above the critical temperature (Tc) and pressure (Pc) of the feed mixture and the product mixture, also desirably above the cricondenbar.

Figure 9:
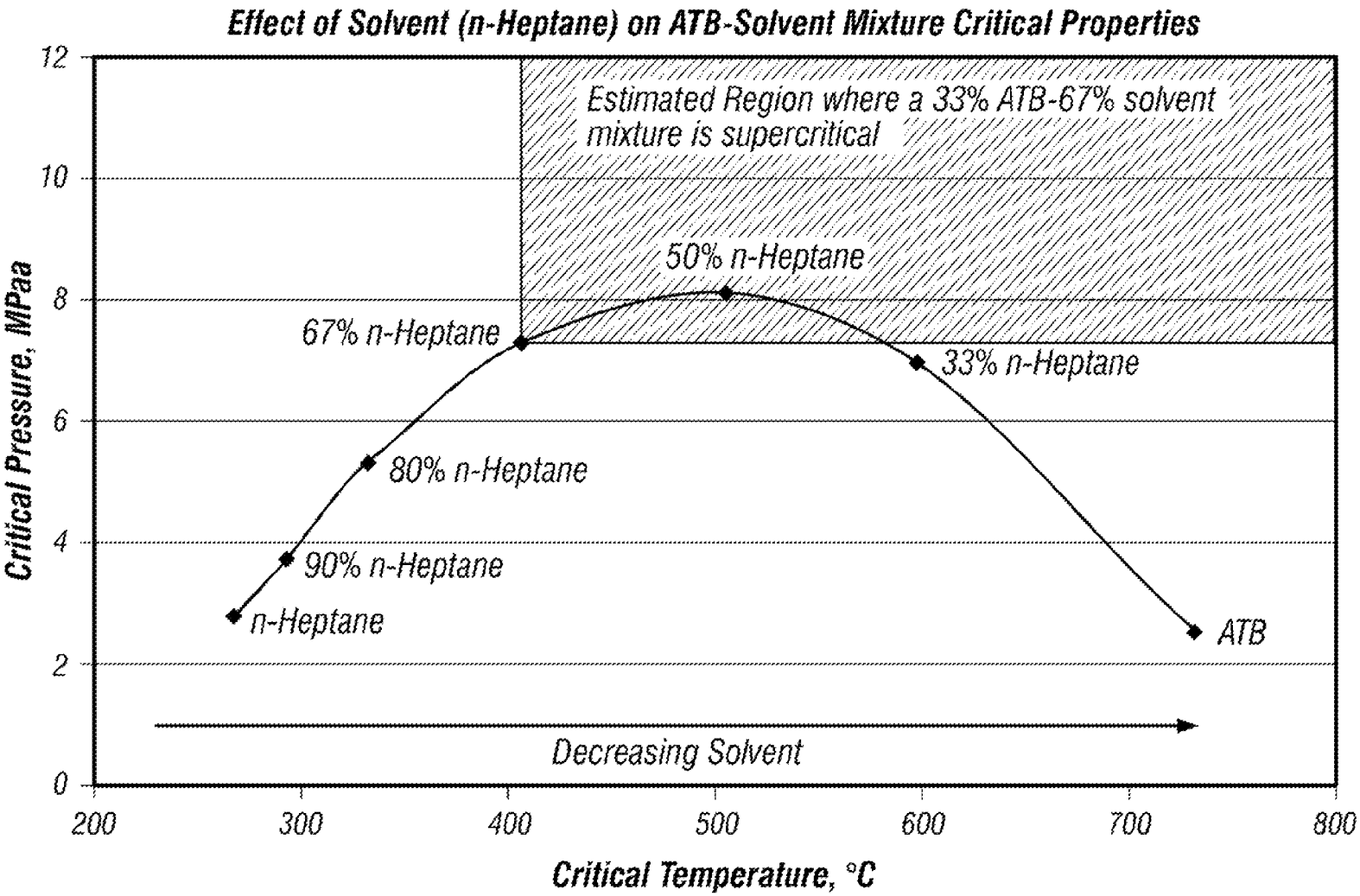
FIG. 9 depicts a critical pressure-temperature diagram showing the effect of solvent on the estimated critical pressure and temperature for the ATB-heptane system.
Figure 10:
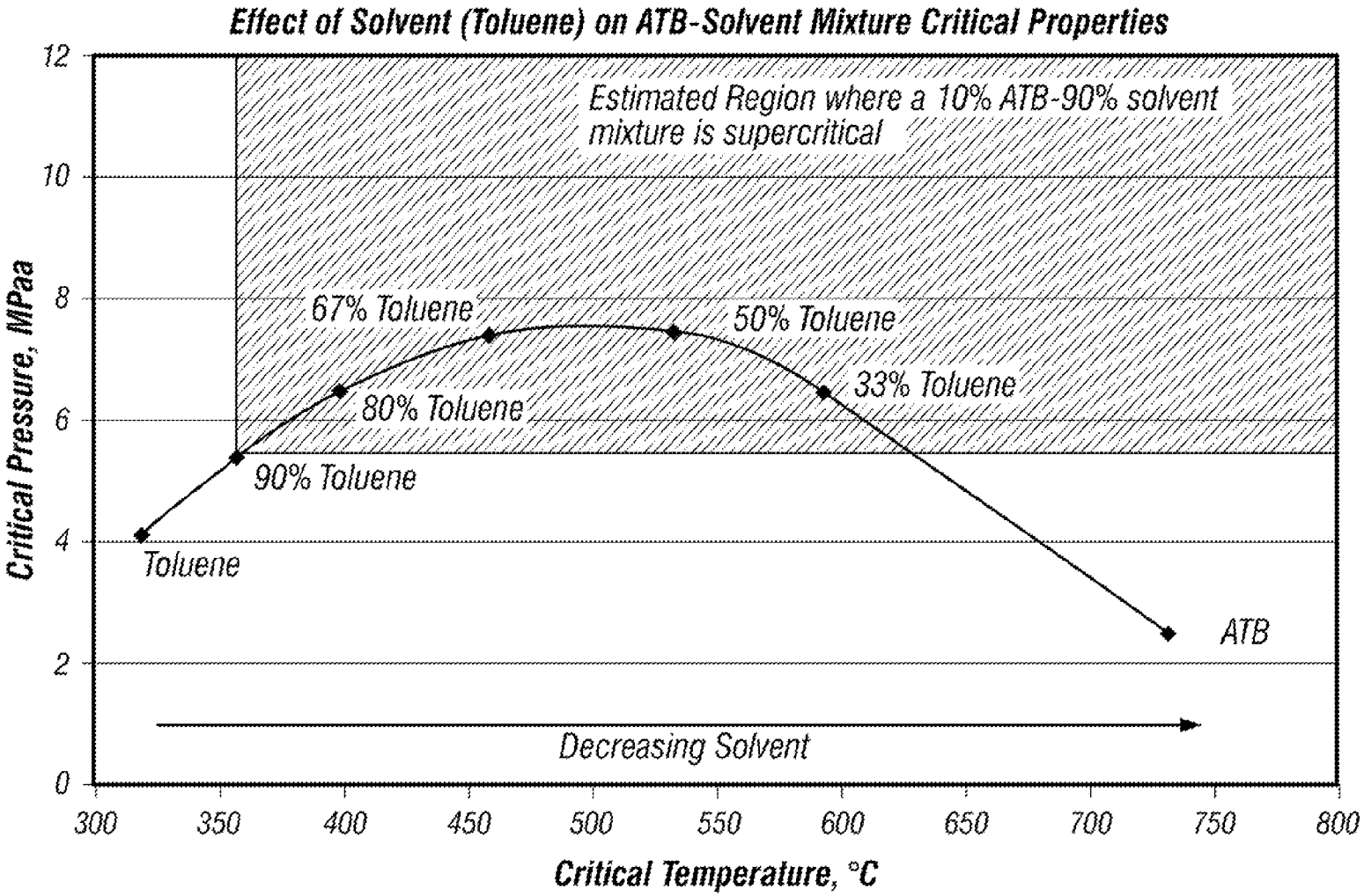
FIG. 10 depicts a critical pressure-temperature diagram showing the effects of solvent on the estimated critical pressure and temperature for the ATB-toluene system.
Figure 11:
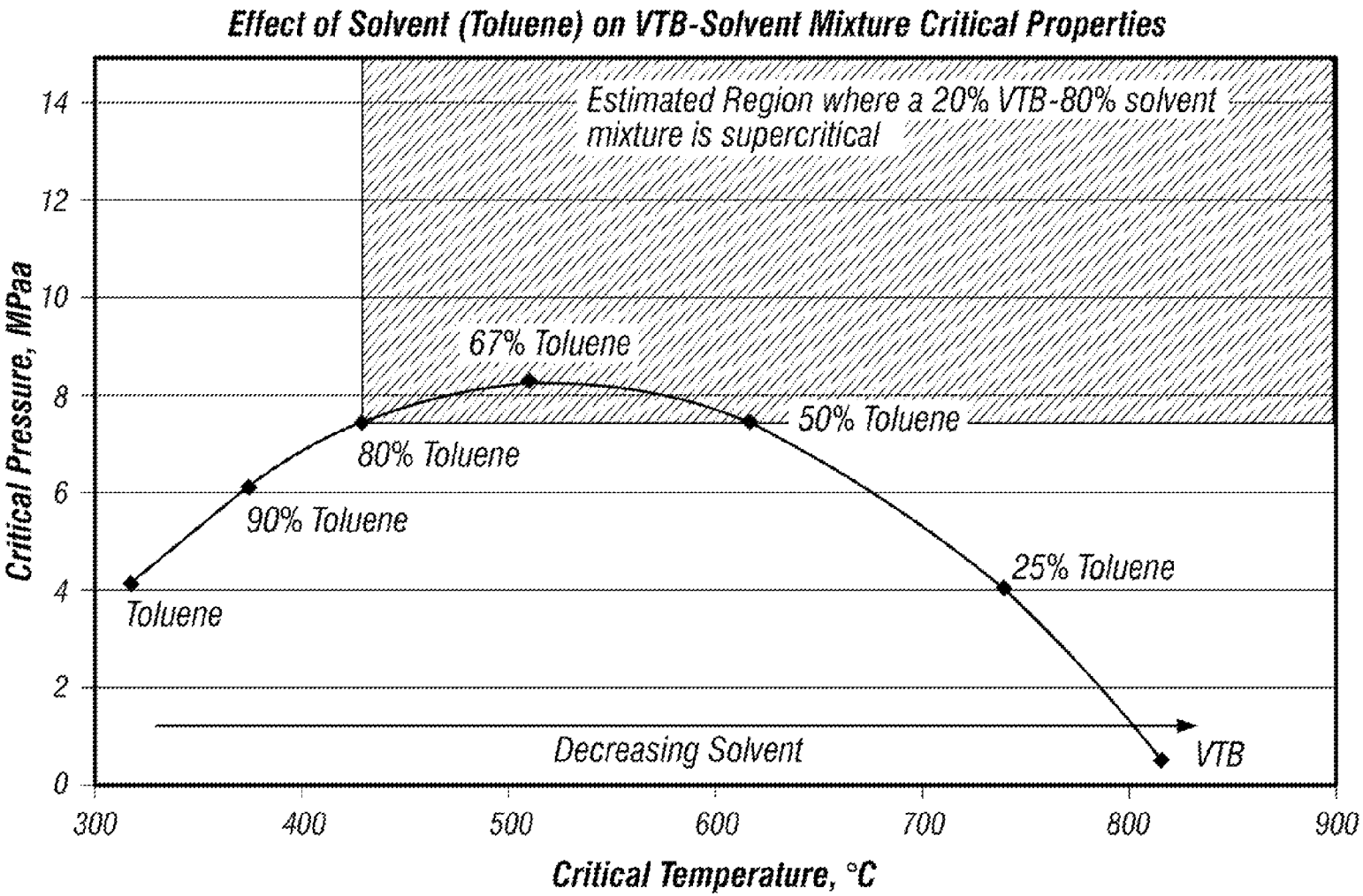
FIG. 11 depicts a critical pressure-temperature diagram showing the effects of solvent on the estimated critical pressure and temperature for the VTB-toluene system.

ATB:n-HEPTANE, ATB:TOLUENE, VTB:TOLUENE Tc/Pc CURVES: FIGS. 9-11 show Tc/Pc curves for ATB/n-heptane, ATB/toluene, and VTB/toluene mixtures, respectively. Because the high-boiling hydrocarbons have a relatively high critical temperature, the use of large solvating hydrocarbon dilution rates may be necessary to reduce the critical temperature of the mixture into the desired range. FIGS. 9-11 demonstrate the influences of proportion of solvent or solvating hydrocarbon used on the critical pressure (Pc) and temperature (Tc) of various feed mixtures. The critical pressures and temperatures were estimated using the Soave-Redlick-Kwong equation of state, with error ranges expected to be on the order of +/−8.3° C. (15° F. and +/−0.34 MPa (50 psi). For the ATB-heptane system in FIG. 9, for example, the Tc and Pc for ATB are 731° C. (1348° F.) and 2.5 MPa (361 psia) respectively, and for n-heptane the Tc and Pc are 267° C. (513° F.) and 2.7 MPa (397 psia). A 33 wt % n-heptane/67 wt % ATB mixture has a supercritical temperature of 596° C. (1106° F.). At a 50-50 ratio, the Tc is lowered to 504° C. (940° F.). The desired temperature range to run the supercritical conversion is between 427° and 482° C. (800° and 900° F.), calling for the n-heptane concentration to be greater than 50 percent, desirably greater than 55%. Note also that the critical pressure for this mixture is greater than either the solvating hydrocarbons or ATB alone, as is typical for a mixed hydrocarbon system. However, when an 80 wt % n-heptane/20 wt % ATB mixture is used, the Tc is about 332° C. (629° F.) and Pc is about 5.3 MPa (765 psia) for the feed mixture. Similar observations are evident from FIG. 10 for the ATB-toluene system.

FIG. 11 for the VTB-toluene system indicates a similar Tc/Pc trend, with a major difference being that VTB has a higher Tc than ATB, requiring more solvating hydrocarbons to bring the critical temperature of the solvating hydrocarbons-feedstock mixture to a suitable conversion temperature range. For example, at 50-weight percent toluene, the VTB-toluene mixture has a critical temperature of 617° C. (1142° F.), compared to a critical temperature of 429° C. (805° F.) for 80-weight percent toluene.

Figure 12:
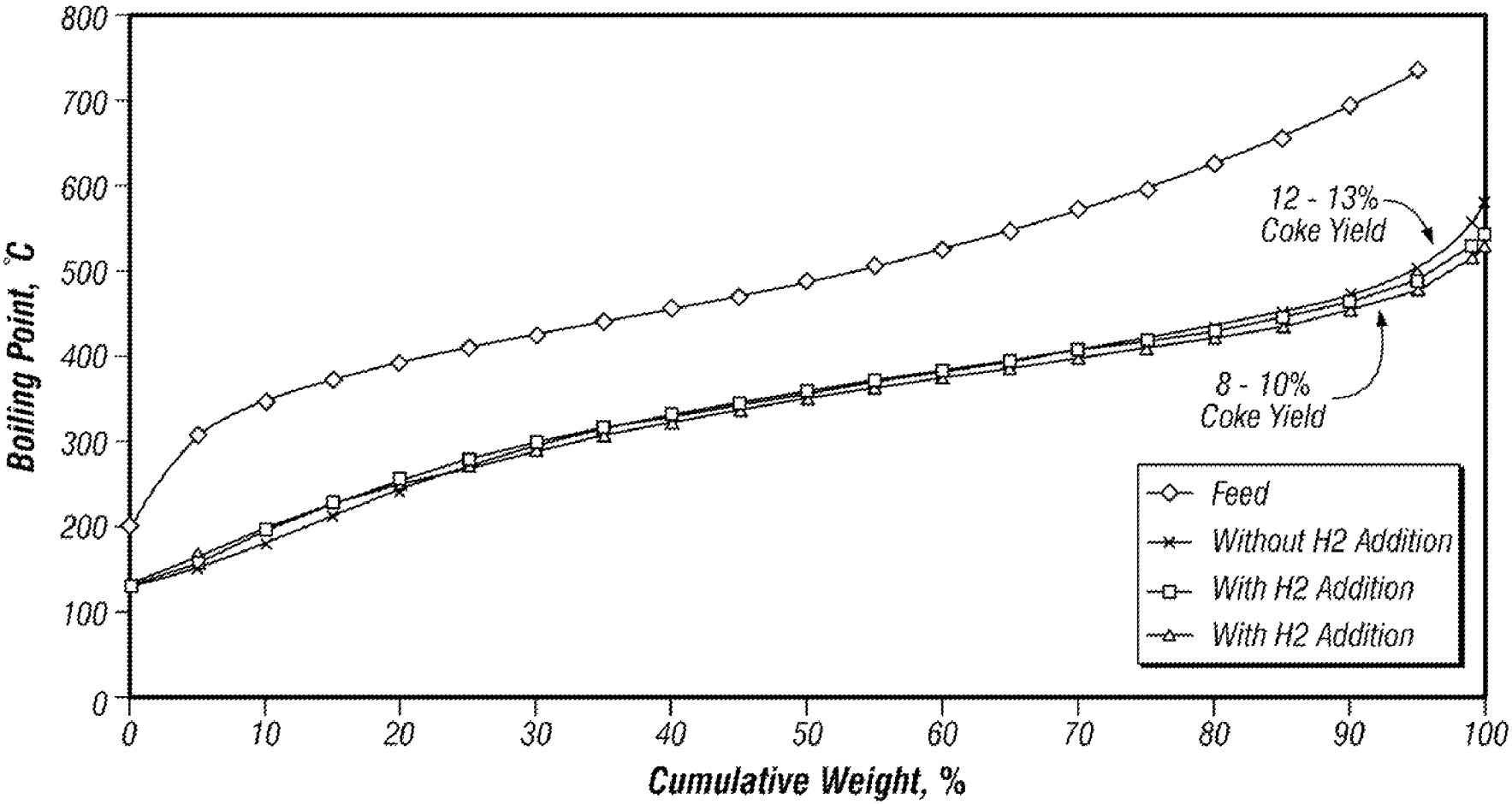
FIG. 12 depicts a boiling point curve for the simulated distillation of the products from a bitumen:toluene (1:4 by weight) feed mixture that has been supercritically processed, showing the effect of solid alumina and hydrogen on the conversion of the high boiling material.

BITUMEN:TOLUENE (1:4) WITH AND WITHOUT HYDROGEN: A bitumen:toluene (1:4, weight basis) feedstock mixture was converted over alumina at 454° C. (850° F.) and 10.1 MPa (1465 psia) in the FIG. 7 apparatus, with and without hydrogen addition at 900 standard cubic meters per cubic meter of oil (5000 standard cubic feet per (42-gallon) barrel (SCFB) of oil). FIG. 12 shows a boiling point curve for a simulated distillation of the bitumen feed and the reactor products. Under supercritical conversion conditions, there was essentially complete conversion of the 538° C.+ (1000° F.+) feed material. The presence of hydrogen improved the conversion yield of high-boiling hydrocarbons only slightly, and reduced the coke yield from about 12-13% without hydrogen addition to about 8-10% with hydrogen addition.

Figure 13:
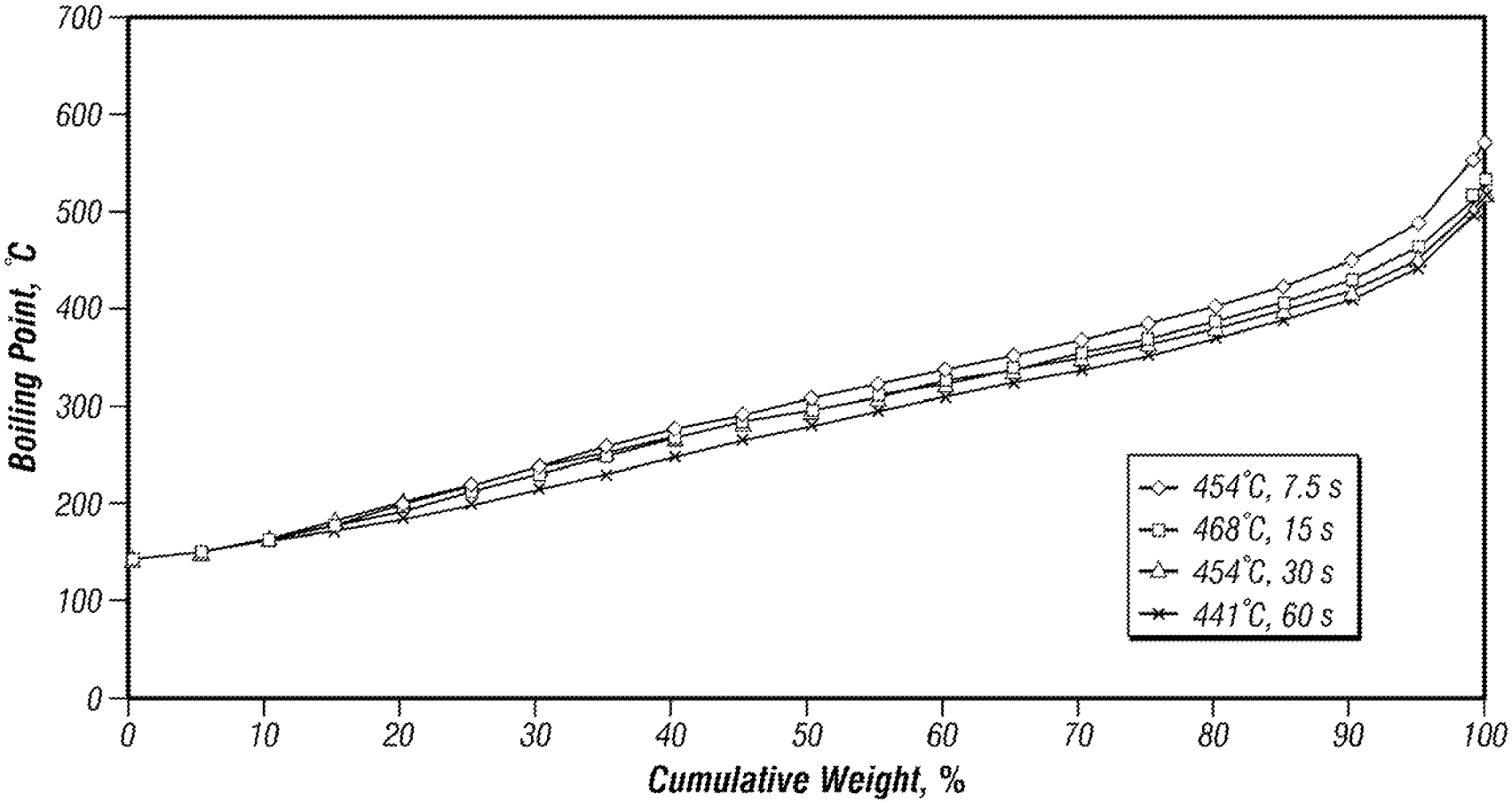
FIG. 13 depicts a boiling point curve for the simulated distillation of the products from a bitumen:toluene (1:4 by weight) feed mixture that has been supercritically processed over alumina, with varying temperatures and residence times.

BITUMEN:TOLUENE, EFFECT OF TIME/TEMPERATURE: A bitumen:toluene (1:4, weight basis) feedstock mixture was converted over alumina at 10.1 MPa (1465 psia) in the FIG. 7 apparatus, at varying reaction times and temperatures. FIG. 13 shows a boiling point curve for a simulated distillation of the bitumen feed and the reactor products. Essentially complete conversion of the 566° C.+ (1050° F.+) materials in the feed was achieved for the runs at the following residence times and temperatures: 15 seconds at 468° C. (875° F.), 30 seconds at 454° C. (850° F.), and 60 seconds at 441° C. (825° F.). A residence time of 7.5 seconds at 482° C. (900° F.) resulted in the conversion of approximately 90 percent of the 566° C.+ (1050° F.+) feed. While it is feasible to have conversion of the high boiling hydrocarbons at low residence times (i.e. on the order of less than 10 seconds), the higher temperatures required for such short residence times lead to less than complete conversion and lower selectivity to the lower boiling hydrocarbons.

Figure 14:
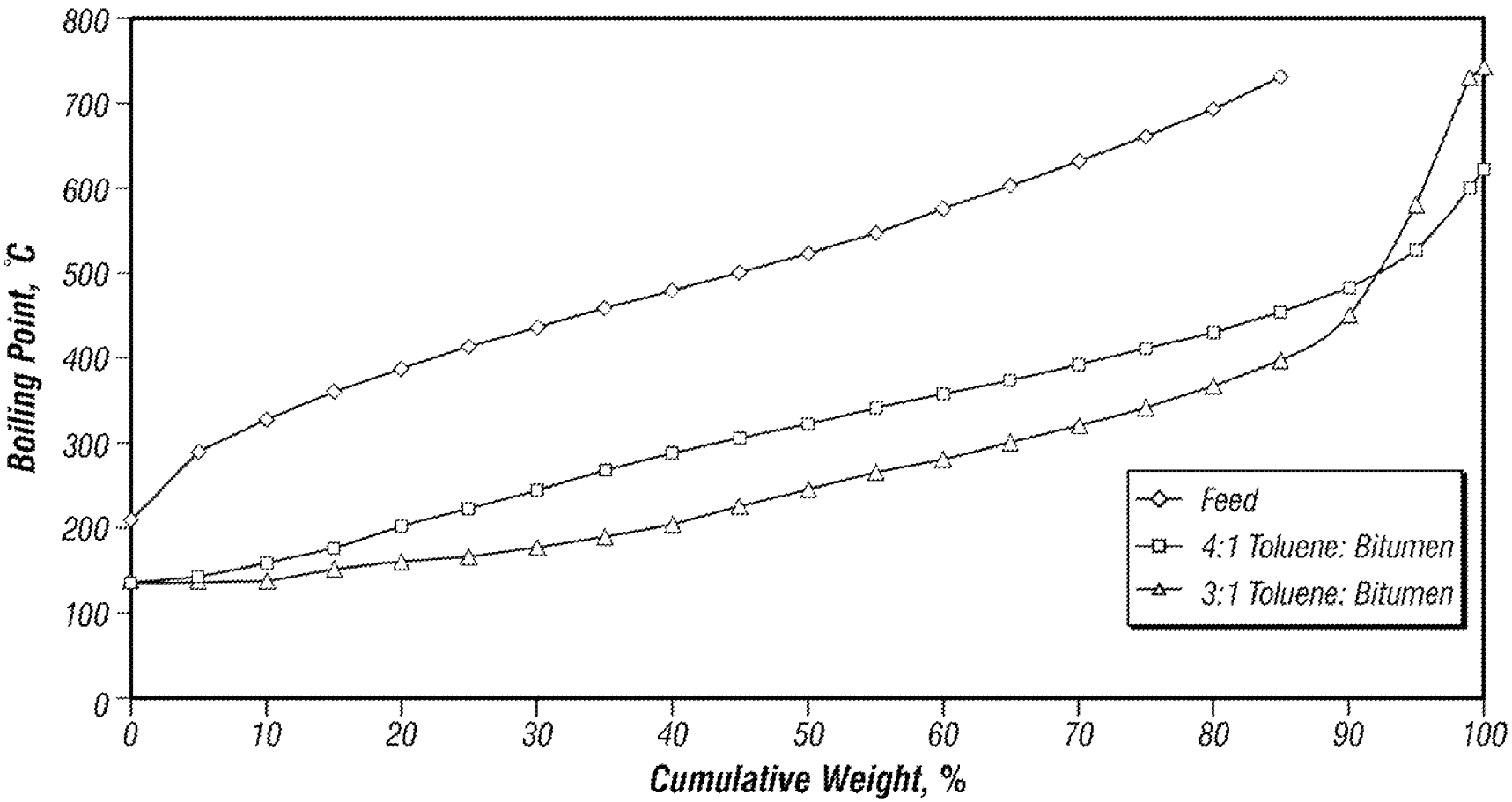
FIG. 14 depicts a boiling point curve for the simulated distillation of the products from a bitumen-toluene feed mixture that has been supercritically processed over alumina, demonstrating the effects of solvent:feed ratios.

BITUMEN:TOLUENE (3:1 AND 4:1), EFFECT OF SOLVENT RATIO: A bitumen:toluene feedstock mixture was converted over alumina at 454° C. (850° F.) and 10.1 MPa (1465 psia) in the FIG. 7 apparatus at feedstock: solvent weight ratios of 1:3 and 1:4 to investigate the effect of solvent dilution rates. The product boiling point curves seen in FIG. 14 show that increasing the solvent:feed ratio results in improved conversion of the 566° C.+ (1050° F.+) feed fraction and less conversion of the hydrocarbons boiling below about 427° C. (800° F.).

HYDROTREATING REACTOR EFFLUENT WITH SOLVENT: To simulate the complete conversion and hydrotreatment of a high boiling feedstock, bitumen feedstock was first converted over alumina to lower boiling hydrocarbons and the resulting lower boiling hydrocarbons were then hydrotreated to remove inorganic impurities. The supercritical conversion was conducted approximately 50 times in an effort to obtain approximately 10 liters of converted product. In a typical conversion run, a 1:4 bitumen:toluene feedstock mixture was converted over alumina at 482° C. (900° F.) and 10.1 MPaa (1465 psia), without the addition of hydrogen. The conversions were run for less than 30 seconds each. Fresh alumina was added to the cracking reactor for each individual run. The resulting product was collected, distilled, and analyzed. The distillation separated fractions corresponding to hydrocarbon fractions having: (1) normal boiling point less than 132° C. (270° F.), (2) normal boiling point between 132° and 221° C. (270° and 430° F.), (3) normal boiling points between 221° and 343° C. (430° and 650° F.), (4) normal boiling points between 343° and 538° C. (650° and 1000° F.), and (5) normal boiling points above 538° C. (1000° F.). The fraction having normal boiling points less than 132° C. (270° F.) was collected to account for the toluene solvent present in the reaction mixture. The fractions, excluding the fraction having boiling points greater than 538° C. (1000° F.), were then recombined in the same proportion for hydrotreatment.

The hydrotreating runs were conducted using commercially available hydrotreating catalyst and toluene at a solvent to feedstock ratio of 4:1 on a weight basis. The catalyst was stabilized prior to hydrotreating the converted bitumen samples, by hydrotreating a 4:1 (weight basis) toluene:light cycle oil (LCO) mixture for 15 days. The hydrotreating reactor was operated at 371° C. (700° F.) and 9.8 MPaa (1415 psia), with liquid hourly space velocity (LHSV) of between 1.6 and 2.4/hr and hydrogen addition at a rate of 214 standard cubic meters per cubic meter of oil (1200 SCFB). The hydrotreating runs were conducted for a period of 16 hours. When not in use, the hydrotreatment system was purged and pressurized with hydrogen to maintain the hydrotreating catalyst in a reducing environment. Between each individual run, a light cycle oil (LCO):toluene sample was hydrotreated to ensure the activity of the hydrotreatment catalyst remained constant. The hydrotreated hydrocarbon product was then distilled into naphtha, distillate, and gas oil fractions. The results of the cracking and hydrotreatment are presented in Table 1.

TABLE 1

| Integrated Conversion and Hydrotreating | | | | | | |
|---|---|---|---|---|---|---|
| | Recovered Fraction | | | | | |
| | Naphtha 131°-221° C. (270°-430° F.) | | Distillate 221°-343° C. (430°-650° F.) | | Gas Oil 343°-538° C. (650°-1000° F.) | |
| | Conversion (1) or Hydrotreating (2) | | | | | |
| | 1 | 2 | 1 | 2 | 1 | 2 |
| Mass percent of whole hydrotreating reactor effluent including solvent (3) | 3.21% | | 5.05% | | 5.99% | |
| Density at 15° C. (59° F.), g/cc | 0.8349 | 0.8271 | 0.9077 | 0.8917 | 0.9869 | 0.951 |
| Total Sulfur, ppmw | 10400 | 347 | 20200 | 219 | 31900 | 1762 |
| Total Nitrogen, ppmw | 36 | 3 | 5000 | 103 | 2300 | 1042 |
| Carbon, weight percent | 85.9 | 87.6 | 84.8 | 87.4 | 84.0 | 88.6 |
| Hydrogen, weight percent | 12.2 | 12.4 | 11.2 | 11.8 | 10.7 | 11.2 |
| Paraffins, weight percent | 4.5 | | 7.9 | 14.0 | 2.9 | 4.9 |
| Iso-paraffins, weight percent | 12.6 | | | | | |
| Olefins, weight percent | 13.3 | | | | | |
| Naphthenes, weight percent | 9.7 | | | | | |
| Cycloalkanes, weight percent | | | 41.1 | 38.5 | 10.2 | 12.1 |
| Aromatics, weight percent | 56.1 | | 51.0 | 47.6 | 86.9 | 83.1 |
| Conradson Carbon Residue (CCR), weight percent | | | | | 0.7 | 0.2 |

(1) - Converted Bitumen (after supercritical conversion);
(2) - Hydrotreated hydrocarbon product;
(3) - Some of the bitumen contained and/or was converted to low boiling hydrocarbons or coke during the alumina reactor runs.
General Note:
ppmw = parts per million on a weight basis Hydrotreatment of the converted product leads to a reduction in the content of both sulfur and nitrogen in the product. Hydrotreatment of the naphtha fraction led to a reduction of sulfur of approximately 97% (by weight), and a reduction of nitrogen of approximately 92%. Hydrotreatment of the distillate fraction led to a reduction of sulfur of approximately 99% and a reduction of nitrogen of approximately 98%. Hydrotreatment of the gas oil fraction led to a reduction of sulfur of approximately 94% and a reduction of nitrogen of approximately 55%. Hydrotreatment of the gas oil fraction also showed a reduction in Conradson Carbon Residue (CCR) of approximately 71.4% (by weight).

A preliminary design and simulation for a commercial plant for processing 198 cubic meters/hr (30,000 BPSD (barrels per stream day)) of bitumen with solvent recovery and recycle at a solvent:bitumen weight ratio of 4:1 was developed according to the process of FIG. 2. The bitumen feed 104 is mixed with the recycle solvent 102 (boiling point range 24 to 253° C. (76° to 488° F.) and preheated to 399° C. (750° F.). The reactor has a mixing zone made from a 4.9 meter (16 ft) long, 1 meter (39 in.) ID pipe with a 30 cm (12 in.) thick refractory lining, and a riser 114 made from a 19.5 meter (64 ft) length of 0.69 meter (27 in.) ID pipe also with a 30 cm (12 in.) thick refractory lining. The regenerated solids are supplied via crossover 136 to the reactor at 760° C. (1400° F.) at a weight ratio of feed mix:solids of 1:1 to obtain a reaction temperature of about 471° C. (880° F.) at a nominal pressure of about 10.1 MPaa (1465 psia). The reactor riser effluent is separated in a conventional cyclone 116 with a 0.76 meter (60 in.) ID, 2.3 meter (7.5 ft) long barrel and a 3.8 meter (12.5 ft) cone. The recovered solids have a delta-coke (change in weight % coke) of about 2 weight percent of the regenerated solids, and are regenerated with a 50:50 weight mixture of oxygen and steam preheated to 482° C. (900° F.). The process is started up using naphtha as the solvent, and at steady state the solvent recovered from the effluent for recycle to the reactor riser has a boiling point range from 24° to 253° C. (76° to 488° F.). The regenerator is operated at 760° C. (1400° F.) and a nominal pressure of about 10.1 MPaa (1465 psia), and has a mixing zone made from a 4.6 meter (15 ft) long, 0.69 meter (27 in.) ID pipe with a 30 cm (12 in.) thick refractory lining, and a riser 126 made from a 18.3 meter (60 ft) length of 0.46 meter (18 in.) ID pipe also with a 30 cm (12 in.) thick refractory lining. The regenerated solids are recovered from the regenerator riser effluent in a conventional cyclone 128 with a 1 meter (39 in.) ID, 1.5 meter (5 ft) long barrel and a 2.4 meter (8 ft) cone. The flow composition, flow rates, pressure and temperature of selected streams are presented in Table 2 that follows.

TABLE 2

| Selected Streams in Commercial Plant for VTB Feed | | | | | | |
|---|---|---|---|---|---|---|
| | Vacuum Tower Bottoms (VTB) | Solvent | Regenerated Solids | Reactor Product | Solids to Regeneration | Low Heating Value Gas |
| Stream Number | 108 | 106 | 136 | 118 | 124 | 130 |
| Mass Flow kg/hr | 201,282 | 805,127 | 1,001,361 | 1,029,640 | 1,023,502 | 140,716 |

TABLE 2-continued

| Selected Streams in Commercial Plant for VTB Feed | | | | | | |
|---|---|---|---|---|---|---|
| | Vacuum Tower Bottoms (VTB) | Solvent | Regenerated Solids | Reactor Product | Solids to Regeneration | Low Heating Value Gas |
| Nominal Pressure, MPaa | 10.3 | 10.3 | 10.1 | 10.1 | 10.3 | 10.1 |
| Temperature ° C. | 149 | 116 | 760 | 471 | 471 | 750 |
| Component Flows, kg/hr | | | | | | |
| CO | 0 | 0 | 0 | 0 | 0 | 14,303 |
| CO2 | 0 | 0 | 0 | 0 | 0 | 46,114 |
| H2 | 0 | 0 | 0 | 0 | 0 | 1,730 |
| H2S | 0 | 0 | 0 | 604 | 0 | 2,353 |
| O2 | 0 | 0 | 0 | 0 | 0 | 0 |
| SOLIDS | 0 | 0 | 1,001,361 | 0 | 1,001,361 | 0 |
| COKE | 0 | 0 | 0 | 0 | 22,141 | 0 |
| WATER | 0 | 0 | 0 | 45,372 | 0 | 76,215 |
| C1-C4 | 0 | 0 | 0 | 3,522 | 0 | 0 |
| C5-C7 | 0 | 0 | 0 | 4,026 | 0 | 0 |
| 22-43° C. | 0 | 23,511 | 0 | 23,528 | 0 | 0 |
| 43-96° C. | 0 | 251,193 | 0 | 251,374 | 0 | 0 |
| 96-163° C. | 0 | 297,926 | 0 | 325,981 | 0 | 0 |
| 163-204° C. | 0 | 158,551 | 0 | 185,535 | 0 | 0 |
| 204-263° C. | 0 | 73,947 | 0 | 108,656 | 0 | 0 |
| 263-385° C. | 0 | 0 | 0 | 63,333 | 0 | 0 |
| 385-539° C. | 31,849 | 0 | 0 | 16,684 | 0 | 0 |
| 539-621° C. | 69,714 | 0 | 0 | 1,024 | 0 | 0 |
| 621-756° C. | 79,591 | 0 | 0 | 0 | 0 | 0 |
| 756-870° C. | 18,115 | 0 | 0 | 0 | 0 | 0 |
| 870-1027° C. | 2,013 | 0 | 0 | 0 | 0 | 0 |

In another embodiment, systems and methods for staging an investment for hydrocarbon conversion are provided. The investment can be divided into at least two stages, a first stage having one or more gasification systems that are constructed and operated to generate sufficient capital to support the construction and operation of a second stage having one or more hydrocarbon conversion systems that can operate at supercritical or non-supercritical conditions. The staged investment can be further described with reference to FIGS. 15 and 16.

Figure 15:
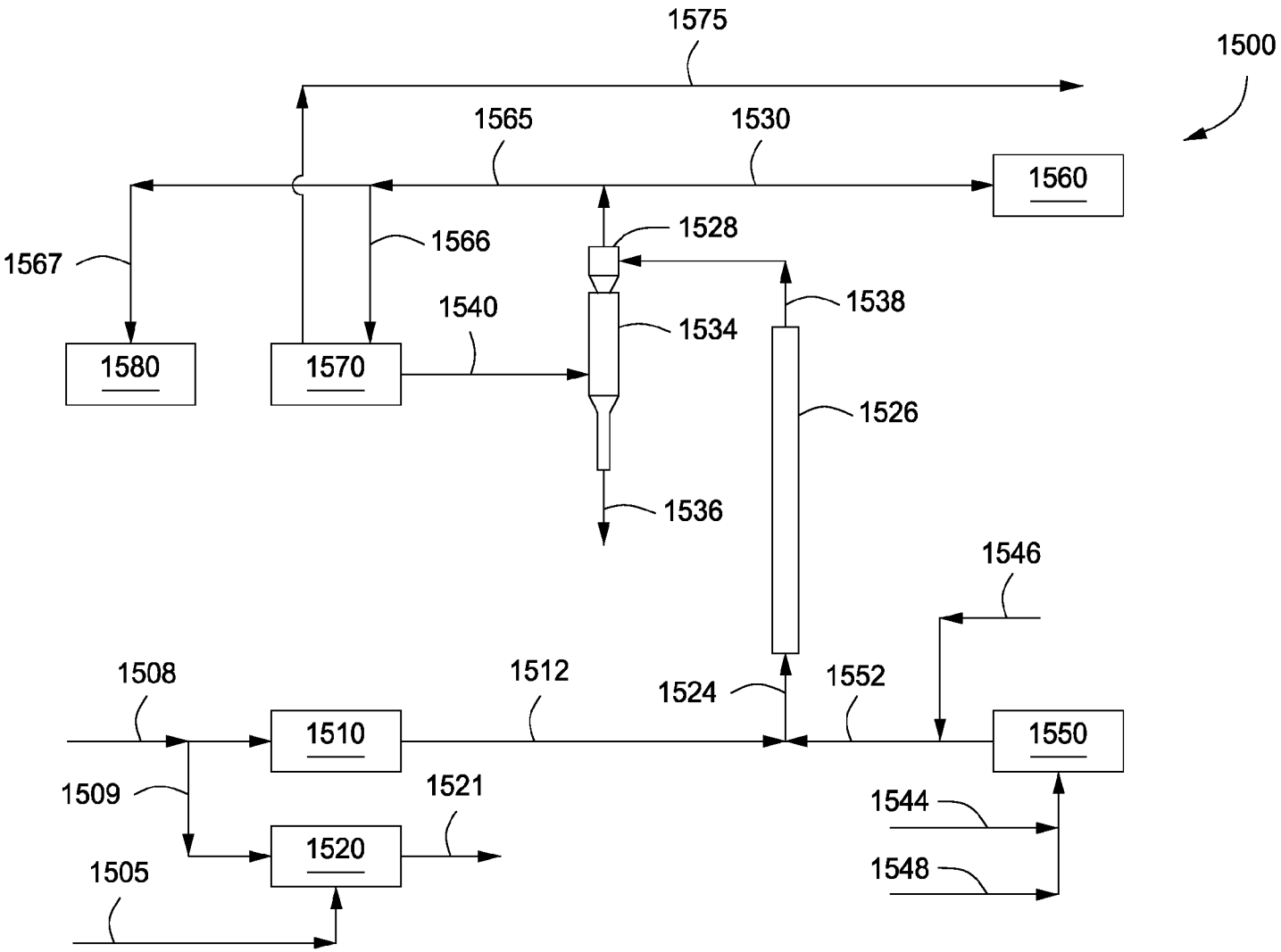
FIG. 15 depicts an illustrative hydrocarbon gasification system for a first stage of an investment according to one or more embodiments described.

FIG. 15 depicts an illustrative hydrocarbon gasification system 1500 for the first stage of investment according to one or more embodiments. The hydrocarbon gasification system 1500 can include one or more preheaters (two are shown 1510, 1550); one or more dilution units 1520; one or more risers 1526; one or more separators 1528; one or more strippers 1534; one or more gas processing units 1560; one or more steam generators 1570; and one or more electrical generators 1580. The gasification system 1500 can be located proximate to a reservoir containing one or more hydrocarbons. After extraction from the reservoir, the one or more hydrocarbons via line 1508 can be apportioned into a first portion and a second portion. The hydrocarbon feed in line 1508 can contain one or more crude hydrocarbons including, but not limited to, oil sands, tar sands, bituminous sands, extra-heavy oils, oil shales, wellhead crude, atmospheric distillation column bottoms, vacuum distillation column bottoms, residual compounds from a solvent de-asphalting process, combinations thereof, derivatives thereof, or mixtures thereof. In one or more embodiments, the hydrocarbon feed in line 1508 can have a normal bulk boiling point greater than 538° C. (1000° F.). In one or more embodiments, the hydrocarbon feed can have an API specific gravity (at 60° F.) of from about 5° API to about 22.5° API; about 5° API to about 15° API; or about 5° API to about 12.5° API.

In one or more embodiments, the first portion of the hydrocarbon feed in line 1508 can be heated using one or more feed preheaters 1510 to provide a preheated feed via line 1512. In one or more embodiments, the preheated feed in line 1512 can have a temperature of from about 100° C. (212° F.) to about 540° C. (1,000° F.); about 200° C. (390° F.) to about 540° C. (1,000° F.); or about 300° C. (570° F.) to about 540° C. (1,000° F.). All or a portion of the first portion can be combusted to provide steam via one or more steam generators 1570 and/or electrical energy via one or more electrical generators 1580. At least a portion of the steam can be used to stimulate additional crude hydrocarbon extraction from the reservoir, a process typically known as steam assisted gravity drainage ("SAGD").

The one or more feed preheaters 1510 can include, but are not limited to, shell-and-tube, plate and frame, or spiral wound heat exchanger designs. In one or more embodiments, a heating medium such as steam, hot oil, electric resistance heat, or any combination thereof can be used to add the necessary heat to the hydrocarbon feed in line 1508 to provide the preheated feed in line 1512. The feed preheater 1510 can be an interchanger or regenerative type heater using one or more hot process fluids and/or hot waste streams to provide heat to the hydrocarbon feed in line 1508. In one or more embodiments, the one or more feed preheaters 1510 can be a direct fired heater or the equivalent. In one or more embodiments, the operating temperature of the one or more feed preheaters 1510 can range from about 100° C. (212° F.) to about 540° C. (1,000° F.); about 200° C. (390° F.) to about 540° C. (1,000° F.); or about 300° C. (570° F.) to about 540° C. (1,000° F.). In one or more embodiments, the operating pressure of the one or more feed pre-heaters 1510 can range from about 100 kPa (0 psig) to about 2,000 kPa (275 psig); about 300 kPa (30 psig) to about 2,000 kPa (275 psig); about 500 kPa (60 psig) to about 2,000 kPa (275 psig).

In one or more embodiments, the second portion of the hydrocarbon feed in line 1508 can be withdrawn via line 1509 and can be introduced to one or more dilution systems 1520 to provide one or more fungible hydrocarbon products which can be sold to provide capital for the second investment stage. For example, the hydrocarbon feed via line 1509 and one or more diluents via line 1505 can be mixed or otherwise combined at a sufficient ratio to provide one or more lower viscosity, fungible, hydrocarbon products via line 1521. The ratio of oil to diluent can vary depending on the desired end-use and market for the product. Illustrative volume ratios can vary between 1:1 and 1:100 oil to diluent, more particularly about 1:5, 1:10; 1:25; or 1:50.

The one or more dilution systems 1520 can include any device, system or combination of systems and/or devices to combine, mix and/or homogenize the hydrocarbon feed via line 1509 and the one or more diluents in line 1505. The dilution system 1520 can include, but is not limited to, one or more powered in-line mixers, mixers in one or more vessels, blenders, homogenizers, or any combination thereof. In one or more embodiments, the dilution system 1520 can include one or more in-line static mixers. In one or more embodiments, the one or more dilution systems 1520 can operate at a temperature range of from about 20° C. (70° F.) to about 200° C. (390° F.); from about 20° C. (70° F.) to about 150° C. (300° F.); or from about 20° C. (70° F.) to about 100° C. (210° F.). In one or more embodiments, the one or more dilution systems 1520 can operate at a pressure of from about 100 kPa (15 psig) to about 1,475 kPa (200 psig); from about 100 kPa (15 psig) to about 1,130 kPa (150 psig); or from about 100 kPa (15 psig) to about 790 kPa (100 psig).

The preheated feed in line 1512 can be mixed with one or more oxidants at or near the introduction to the riser 1526. In one or more embodiments, the one or more oxidants via line 1544 and steam via line 1548 can be combined and heated using one or more oxidant preheaters 1550 to provide a heated oxidant via line 1552. In one or more embodiments, the oxidants in line 1544 can contain air, oxygen-enriched air, oxygen, or any combination thereof. As used herein, "oxygen-enriched air" refers to mixture containing air and oxygen having an oxygen concentration exceeding 22%. In one or more embodiments, oxygen and/or oxygen-enriched air can be produced using an air separation unit (not shown) via cryogenic distillation, pressure swing adsorption, membrane separation or any combination thereof. In one or more embodiments, the oxygen concentration in line 1544 can range from about 21% wt to about 99.9% wt; about 50% wt to about 99.9% wt; or about 80% wt to about 99.9% wt.

In one or more embodiments, the steam in line 1548 can be saturated or superheated. In one or more embodiments, the steam in line 1548 can be saturated, having a pressure ranging from about 1,000 kPa (130 psig) to about 8,300 kPa (1,190 psig); about 1,000 kPa (130 psig) to about 6,200 kPa (885 psig); or about 1,000 kPa (130 psig) to about 4,200 kPa (595 psig). In one or more embodiments, the heated oxidant in line 1552 can be at a temperature of from about 100° C. (212° F.) to about 540° C. (1,000° F.); about 200° C. (390° F.) to about 540° C. (1,000° F.); or about 300° C. (570° F.) to about 540° C. (1,000° F.).

The one or more oxidant preheaters 1550 can include, but are not limited to shell-and-tube, plate and frame, or spiral wound heat exchanger designs. In one or more embodiments, a heating medium such as steam, hot oil, electric resistance heat, or any combination thereof can be used to add the necessary heat to the one or more oxidants and/or steam to provide the heated oxidant in line 1552. The oxidant preheater 1550 can be an interchanger or regenerative type heater using one or more hot process fluids and/or hot waste streams to provide heat to the heated oxidant in line 1552. In one or more embodiments, the one or more oxidant preheaters 1550 can be a direct fired heater or the equivalent. The one or more oxidant preheaters 1550 can operate at a temperature of from about 100° C. (212° F.) to about 540° C. (1,000° F.); about 200° C. (390° F.) to about 540° C. (1,000° F.); or about 300° C. (570° F.) to about 540° C. (1,000° F.). In one or more embodiments, the one or more oxidant preheaters 1550 can operate at a pressure of from about 100 kPa (0 psig) to about 2,000 kPa (275 psig); about 300 kPa (30 psig) to about 2,000 kPa (275 psig); about 500 kPa (60 psig) to about 2,000 kPa (275 psig).

One or more non-catalytic solids can be introduced via line 1546 to the heated oxidant in line 1552. In one or more embodiments, the non-catalytic solids in line 1546 can be preheated prior to mixing with the heated oxidant in line 1552. The one or more non-catalytic solids can include, but are not limited to, refractory oxides, and/or other inert materials. The one or more refractory oxides can include, but are not limited to, silicon dioxide ($SiO_2$), aluminum oxide ($Al_2O_3$), aluminum phosphate ($AlPO_4$), titanium dioxide ($TiO_2$), zirconium oxide ($ZrO_2$), chromium oxide ($Cr_2O_3$), mixtures thereof, derivatives thereof and combinations thereof.

The preheated feed in line 1512 can be combined in a mixing zone with the heated oxidant in line 1552 to provide a combined feed in line 1524. In one or more embodiments, the weight ratio of the preheated feed in line 1512 to heated oxidant in line 1552 can range from about 1:1 to 100:1; from about 1:1 to about 50:1; or from about 1:1 to about 25:1. In one or more embodiments, the combined feed in line 1524 can have a temperature from about 100° C. (210° F.) to about 540° C. (1,000° F.); about 200° C. (390° F.) to about 540° C. (1,000° F.); or about 300° C. (570° F.) to about 540° C. (1,000° F.).

After introducing the combined feed 1524 to the one or more risers 1526, at least a portion of the hydrocarbons present in the combined feed can gasify, providing an effluent via line 1538. In one or more embodiments, the effluent in line 1538 can include, but is not limited to, one or more hydrocarbons, one or more hydrocarbon byproducts, solids, mixtures thereof, derivatives thereof, and combinations thereof. In one or more embodiments, at least a portion of the hydrocarbon byproducts can be deposited as a layer of coke on the surface of the solids present in riser 1526, thereby forming one or more coked-solids.

The velocity of the combined feed through the riser 1526 can range from about 1 m/s (3.2 ft/s) to about 20 m/s (64 ft/s); about 1 m/s (3.2 ft/s) to about 15 m/s (48 ft/s); or about 1 m/s (3.2 ft/s) to about 10 m/s (32 ft/s). The combined feed in line 1524 can have a residence time in the riser 1526 of about 0.5 seconds to about 60 seconds; about 0.5 seconds to about 45 seconds; or about 0.5 seconds to about 30 seconds. Insufficient residence time in the riser 1526 can result in inadequate conversion of the hydrocarbon feed, thereby reducing the yield of light hydrocarbons in line 1538. Excessive residence time in the riser 1526 can increase the formation of heavier hydrocarbon byproducts, thereby reducing the yield of light hydrocarbons in line 1538. In one or more embodiments, the light hydrocarbon concentration in line 1538 can range from about 50% vol to about 99% vol; about 50% vol to about 98% vol; or about 50% vol to about 96% vol.

The one or more risers 1526 can be any device or system suitable for maintaining temperature and pressure of the combined feed 1524 for the desired residence time. The geometry of the riser 1526, including length and diameter, can be based upon a variety of design parameters, including but not limited to, hydrocarbon feed flowrate, operating temperature, operating pressure, and desired retention time. In one or more embodiments, the riser 1526 can be a vertical column having a length-to-diameter ("L/D") ratio of greater than 5. Other geometries providing similar reaction zone residence times and/or velocities may be effective in achieving similar results.

The operating temperature within the one or more risers 1526 can range from about 540° C. (1000° F.) to about 2200° C.; from about 815° C. (1,500° F.) to about 2000° C.; or from about 1,100° C. (2,000° F.) to about 1800° C. The operating pressure within the one or more risers 1526 can range from about 100 kPa (0 psig) to about 10,000 kPa (1,435 psig); from about 100 kPa (0 psig) to about 7,000 kPa (1,000 psig); or from about 100 kPa (0 psig) to about kPa (800 psig).

The effluent in line 1538 can be introduced to one or more separators 1528 to selectively separate and remove, via line 1536, the solids and/or coked-solids, providing a first product via line 1530. In one or more embodiments, the first product in line 1530 can contain a mixture of hydrocarbons resulting in synthesis gas. In one or more embodiments, the first product in line 1530 can be used as a feed in a subsequent gas processing operation 1560. In one or more embodiments, at least a portion of the first product in line 1530 can be diverted via line 1565 and used to provide steam and/or electricity. In one or more embodiments, all or a portion of the first product in line 1565 can be introduced via line 1566 to one or more steam generators 1570. In one or more embodiments, all or a portion of the first product in line 1565 can be introduced via line 1567 to one or more electrical generators 1580. In one or more embodiments, at least a portion of the steam generated can be exported via line 1575 for use in extracting additional crude hydrocarbons using steam assisted gravity drainage (SAGD).

The one or more separators 1528 and one or more strippers 1534 can be any suitable device, system or process for separating solids from a gas stream. In one or more embodiments, the one or more separators 1528 and/or strippers 1534 can encompass a variety of process technology including, but not limited to cyclonic type separators, baffled separators, electrostatic precipitators, or other mechanical or electrical separation technologies in any series and/or parallel arrangement and/or frequency. For example, the separator 1528 can be a cyclonic type separator, while the stripper 1534 can be a baffled vessel having a fluidized bed of coke-covered solids contained therein, disposed adjacent to the one or more separators 1528.

In one or more embodiments, at least a portion of the coked-solids in line 1536 can be used as a supplemental fuel for the generation of steam supplied to the process via line 1548, and/or the steam supplied to the one or more strippers 1534 via line 1540. In one or more embodiments, at least a portion of the solids in line 1536 can be recycled to provide at least a portion of the non-catalytic solids in line 1546. In one or more embodiments, the solids in line 1536 can contain about 1% wt to about 70% wt; about 5% wt to about 60% wt; or about 5% wt to about 25% wt heavy hydrocarbon coke.

In one or more embodiments, at least a portion of the crude hydrocarbons in line 1508 can be mixed or otherwise combined with one or more diluents supplied via line 1505 in the one or more dilution systems 1520 to provide one or more fungible hydrocarbon products via line 1521. The fungible hydrocarbon products in line 1521 can have a viscosity lower than the incoming crude hydrocarbon, thereby facilitating their sale or conversion to provide operating capital or additional investment capital. In one or more embodiments, a minimum of about 50% wt; about 60% wt; about 70% wt; about 80% wt; or about 90% wt of the crude hydrocarbons in line 1508 can be introduced via line 1509 to the one or more dilution systems 1520. The balance of the crude hydrocarbons in line 1508 can be used as a hydrocarbon feed to the preheater 1510.

In one or more embodiments, residual heat from the hydrocarbon gasification system 1500 can be used to pre-heat the system 1600 prior to initiating the hydrocarbons to the system 1600.

Figure 16:
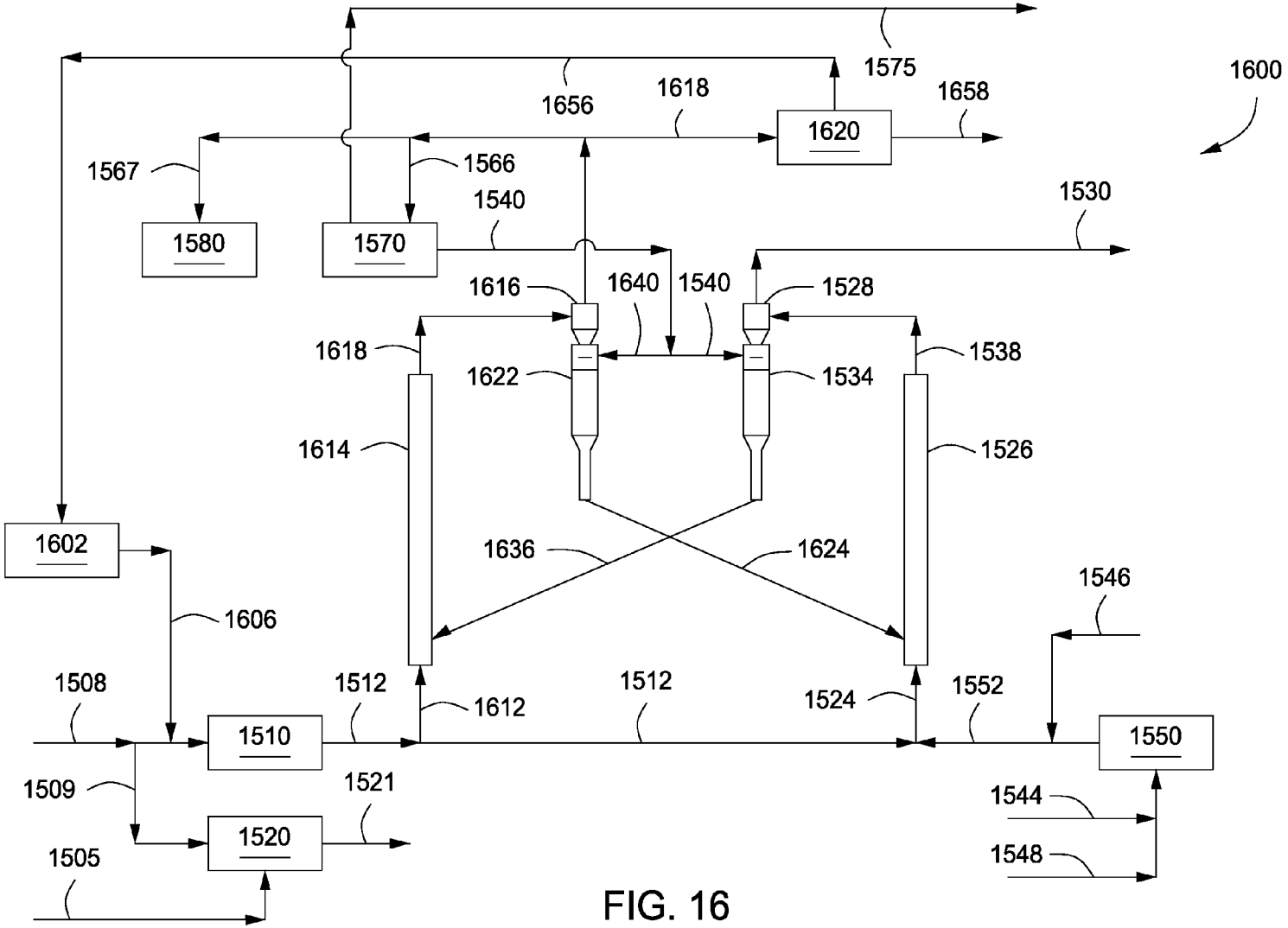
FIG. 16 depicts an illustrative hydrocarbon conversion system for a second stage of an investment according to one or more embodiments described.

FIG. 16 depicts an illustrative hydrocarbon conversion system for a second stage of investment, according to one or more embodiments described. After the system 1500 produces enough fungible product to generate sufficient capital, the second stage of investment can be utilized. The second stage of investment can include the construction of system 1600. The second stage system 1600 can include one or more solvent units 1602; one or more risers 1614; one or more separators 1616; one or more strippers 1622; and one or more product separation units 1660. The system 1600 works in conjunction with the system 1500 described above except that the system 1500 can be converted to a solids regeneration system while the system 1600 operates as a hydrocarbon conversion system.

All or a portion of the hydrocarbon feed in line 1508 can be mixed with one or more solvents introduced via line 1606, and the resultant mixture heated using one or more feed preheaters 1510 to provide a preheated mixture via line 1512. In one or more embodiments, all or a portion of the preheated mixture in line 1512 can be introduced to the riser 1614 via line 1612. In one or more embodiments, the temperature of the preheated mixture in line 1612 can range from about 25° C. (75° F.) to about 100° C. (210° F.) above the bulk critical temperature of the solvent-feed mixture ("$T_{C,S}$"); from about 75° C. (170° F.) to about $T_{C,S}$+100° C. ($T_{C,S}$+210° F.); or from about 150° C. (300° F.) to about $T_{C,S}$+100° C. ($T_{C,S}$+210° F.). In one or more embodiments, a portion of the hydrocarbon feed in line 1508 can be taken, via line 1509, and mixed or otherwise combined with one or more diluents via line 1505 using one or more dilution systems 1520 to provide one or more fungible hydrocarbon products via line 1521.

In one or more embodiments, one or more non-catalytic solids can be introduced via line 1636 to the riser 1614. The one or more non-catalytic solids introduced via line 1636 can include, but are not limited to, refractory oxides, inert materials, mixtures thereof, and/or any combination thereof. In one or more embodiments, the one or more refractory oxides can include, but are not limited to, $SiO_2$, $Al_2O_3$, $AlPO_4$, $TiO_2$, $ZrO_2$, $Cr_2O_3$, mixtures thereof, derivatives thereof and/or combinations thereof. In one or more embodiments, the non-catalytic solids in line 1636 can be heated prior to being introduced to the riser 1614. In one or more embodiments, the solids in line 1636 can have a temperature of from about 25° C. (75° F.) to about $T_{C,S}$+100° C. ($T_{C,S}$+210° F.); from about 75° C. (170° F.) to about $T_{C,S}$+100° C. ($T_{C,S}$+210° F.); or from about 150° C. (300° F.) to about $T_{C,S}$+100° C. ($T_{C,S}$+210° F.). In one or more embodiments, the quantity of non-catalytic solids added via line 1636 to the riser 1614 can be adjusted to compensate for the presence of native or alluvial solids in the hydrocarbon feed in line 1508. The preheated feed-to-solids ratio in the riser 1614 can range from about 2:1 to about 100:1; from about 5:1 to about 70:1; or from about 10:1 to about 50:1.

The hydrocarbons present in the preheated mixture can convert, crack, react and/or reform within the riser 1614 to provide one or more gaseous hydrocarbon products, and one or more hydrocarbon by-products. In one or more embodiments, the velocity of the preheated mixture through the riser

1614 can range from about 1 m/s (3.2 ft/s) to about 10 m/s (32 ft/s); about 1 m/s (3.2 ft/s) to about 5 m/s (16 ft/s); or about 1 m/s (3.2 ft/s) to about 2.5 m/s (8 ft/s). In one or more embodiments, the preheated mixture can have a residence time in the riser 1614 of about 10 seconds to about 60 seconds; about 15 seconds to about 45 seconds; or about 15 seconds to about 30 seconds. Insufficient residence time in the riser 1614 can result in inadequate conversion and/or cracking of the hydrocarbons present in the preheated mixture, reducing the conversion of hydrocarbon feed to light hydrocarbons in line 1618. Excessive residence time in the riser 1614 can increase the formation of heavier hydrocarbon byproducts, thereby reducing the yield of light hydrocarbons in line 1618.

In one or more embodiments, a first portion of the hydrocarbon by-products can be gaseous, while a second portion can deposit on the surface of the non-catalytic solids present in the riser 1614 as a layer of carbonaceous coke. The effluent from the riser 1614 in line 1638 can therefore contain coke-covered solids suspended in one or more gaseous hydrocarbon products and by-products. In one or more embodiments, the temperature of the effluent in line 1638 can be about 300° C. (570° F.) to about 700° C. (1,290° F.); about 350° C. (660° F.) to about 650° C. (1,200° F.); or about 400° C. (750° F.) to about 600° C. (1,110° F.). In one or more embodiments, the pressure of the effluent in line 1638 can range from about 200 kPa (15 psig) to about 5,000 kPa (710 psig); about 500 kPa (60 psig) to about 4,000 kPa (565 psig); or about 750 kPa (95 psig) to about 3,000 kPa (420 psig).

The one or more risers 1614 can be any device or system suitable for maintaining temperature and pressure of the feed mixture in line 1612 for the desired residence time. The geometry of the riser 1614, including length and diameter, can be based upon a variety of design parameters, including but not limited to, hydrocarbon feed flowrate, operating temperature, operating pressure, and desired retention time. In one or more specific embodiments, the riser 1614 can be a vertical column having a length-to-diameter ("L/D") ratio of greater than 5. Other geometries providing similar reaction zone residence times and/or velocities may be effective in achieving similar results. In one or more embodiments, the operating temperature within the one or more risers 1614 can range from about 540° C. (1000° F.) to about the critical temperature of the one or more solvents ("$T_{C,S}$"); from about 815° C. (1,500° F.) to about $T_{C,S}$; or from about 1,100° C. (2,000° F.) to about $T_{C,S}$. In one or more embodiments, the operating pressure within the one or more risers 1614 can range from about 100 kPa (0 psig) to about 10,000 kPa (1,435 psig); from about 100 kPa (0 psig) to about 7,000 kPa (1,000 psig); or from about 100 kPa (0 psig) to about 4,500 kPa (640 psig).

The effluent in line 1638 can be introduced to one or more separators 1616 wherein the coke-covered solids can be selectively separated from the gaseous hydrocarbon products and by-products ("gaseous hydrocarbons"). The gaseous hydrocarbons can exit the separator 1616 via line 1618, the coke-covered solids can drop into one or more strippers 1622. In one or more embodiments, steam via line 1640 can be added to the one or more strippers 1622 to strip or otherwise remove any entrained, trapped or adsorbed gaseous hydrocarbons from the coke-covered solids accumulated therein. In one or more embodiments, the steam in line 1640 can be saturated or superheated. In one or more embodiments, the steam in line 1640 can be saturated, having a pressure ranging from about 200 kPa (15 psig) to about 2,160 kPa (300 psig); from about 200 kPa (15 psig) to about 1,475 kPa (200 psig); or from about 200 kPa (15 psig) to about 1,130 kPa (150 psig). The stripped coke-covered solids can exit the stripper 1622 via line 1624, while the steam and any gaseous hydrocarbons stripped from the solids in the stripper 1622 can exit with the gaseous hydrocarbons via line 1618.

The one or more separators 1616 and one or more strippers 1622 can be any suitable device, system or process for separating solids from a gas stream. In one or more embodiments, the one or more separators 1616 and/or strippers 1622 can encompass a variety of process technology including, but not limited to cyclonic type separators, baffled separators, electrostatic precipitators, or other mechanical or electrical separation technologies in any series and/or parallel arrangement and/or frequency. For example, the separator 1616 can be a cyclonic type separator, while the stripper 1622 can be a baffled vessel having a fluidized bed of coke-covered solids contained therein, disposed adjacent to the one or more separators 1616.

All or a portion of the gaseous hydrocarbons in line 1618 can be introduced to one or more product separation units 1620 wherein the gaseous hydrocarbons can be fractionated, reacted and/or combined to provide one or more finished products via line 1658. In one or more embodiments, all or a portion of the solvent contained in line 1618 can be recovered in the product separation unit 1620 for recycle to the solvent unit 1602 via line 1656. In one or more embodiments, about 30% wt or more; about 50% wt or more; about 70% wt or more; or about 90% wt or more, of the solvent required for dilution of the hydrocarbon feed in line 1508 can be recycled from the product separation unit 1620 via line 1656.

The coke-covered solids in line 1624 can be regenerated in the riser 1526 by mixing the coke-covered particles with steam and an oxidant to combust or otherwise remove the accumulated coke from the surface of the solids to provide an effluent suspension in line 1538 containing one or more waste gases and one or more regenerated, i.e. clean, non-catalytic solids. In one or more embodiments, the riser 1526 can be maintained at a temperature of from about 400° C. (750° F.) to about 1,500° C. (2,730° F.); about 450° C. (840° F.) to about 1,400° C. (2,550° F.) or from about 500° C. (930° F.) to about 1,350° C. (2,460° F.). In one or more embodiments, the riser 1526 can be maintained at a pressure of about 1,500 kPa (200 psig) less than the riser 1614; about 1,000 kPa (145 psig) less than the riser 1614; or about 500 kPa (75 psig) less than the riser 1614.

In one or more embodiments steam via line 1544 and one or more oxidants via line 1548 can be heated using the oxidant preheater 1550 to provide a preheated oxidant via line 1552. In one or more embodiments, the temperature of the preheated oxidant in line 1552 can range from about 100° C. (212° F.) to about 540° C. (1,000° F.); about 200° C. (390° F.) to about 540° C. (1,000° F.); or about 300° C. (570° F.) to about 540° C. (1,000° F.).

In one or more embodiments, for safety, the steam-to-oxidant ratio in the riser 1526 can be maintained at about 1:1 on a weight basis. In one or more alternative embodiments, the combustion within the riser 1526 can take place in an oxidizing environment in the absence of steam. In one or more embodiments, the combustion in the riser 1526 can occur with a stoichiometric excess of oxidant, resulting in a carbon monoxide free effluent in line 1538, or with a sub-stoichiometric amount of oxidant resulting in carbon monoxide in the effluent in line 1538. In one or more embodiments, additional fuel, for example natural gas, can be supplied to the riser 1526 to assist in providing the heat necessary to regenerate the non-catalytic solids. The velocity through the riser 1526 can range from about 0.3 m/sec (1 ft/sec) to about 3 m/sec (10 ft/sec); about 0.3 m/sec (1 ft/sec) to about 2 m/sec (6 ft/sec); or from about 0.7 m/sec (2 ft/sec) to about 1.5 m/sec (6 ft/sec). The residence time in the riser 1526 can range from about 5 seconds to about 120 seconds; from about 10 seconds to about 90 seconds; or from about 10 seconds to about 60 seconds.

The effluent suspension in line 1538 can be introduced to the one or more separators 1528 wherein the regenerated, non-catalytic solids can be selectively separated from the one or more waste gases. In one or more embodiments, the temperature of the effluent in line 1538 can range from about 400° C. (750° F.) to about 1,500° C. (2,730° F.); about 450° C. (840° F.) to about 1,400° C. (2,550° F.) or from about 500° C. (930° F.) to about 1,350° C. (2,460° F.).

The one or more waste gases can exit the separator 1528 via line 1530 for subsequent treatment, reuse, recovery and/or disposal. The regenerated, non-catalytic solids can be introduced to the one or more strippers 1534. In one or more embodiments, steam via line 1540 can be added to the one or more strippers 1534 to strip or otherwise remove any entrained, trapped or adsorbed waste gases from the clean solids. The regenerated, non-catalytic solids can exit the stripper 1534 via line 1636, while the steam and any stripped waste gases can exit with the waste gases via line 1530. In one or more embodiments, the regenerated, non-catalytic solids in line 1636 can be returned via line 1636 to the riser 1614.

The system 1600 can be operated at either non-supercritical conditions (i.e. at temperatures and/or pressures below the critical temperature and/or pressure of the mixture) or supercritical conditions (i.e. at temperatures and/or pressures above the critical temperature and/or pressure of the mixture) within the riser 1614. Where operation of the riser 1614 at supercritical conditions is desired, the hydrocarbon feed in line 1508 can be mixed with one or more solvents having a lower critical temperature, introduced via line 1606 to provide a mixture via line 1512. In one or more embodiments, the mixture in line 1512 can have a bulk critical temperature ranging from about 200° C. (390° F.) to about 535° C. (995° F.); about 250° C. (480° F.) to about 530° C. (985° F.); or from about 300° C. (570° F.) to about 525° C. (975° F.). The volume of solvent used to accomplish the dilution can be used to adjust the critical temperature of the mixture in line 1512.

During start-up of stage two of the investment, at least a portion of the high-temperature effluent in line 1538 can be prevented from exiting the system by partially or completely blocking line 1530. The portion of the high-temperature effluent unable to exit through the blocked line 1530 can instead exit the separator 1528 via the stripper 1534 and be introduced to the riser 1614 via line 1636. The addition of the high-temperature effluent to the riser 1614 can warm the riser 1614 prior to the introduction of the hydrocarbon feed to the riser 1614 via line 1612. Upon riser 1614 reaching the desired operating temperature, the hydrocarbon feed to the riser 1526 can be stopped, solvent flow via line 1606 can be started thereby forming a mixture ("second mixture") within line 1512. The second mixture, containing hydrocarbon feed and one or more solvents, can be introduced to the riser 1614 via line 1612. By preheating the riser 1614 with the high-temperature effluent, the production of undesirable, low-temperature, byproducts within the riser 1614 minimized.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for staging investment in a process comprising:

a first stage comprising:

apportioning a hydrocarbon feed into a first portion and a second portion;

mixing the first portion with one or more oxidants to provide a first mixture;

gasifying at least a portion of the first mixture to provide an effluent;

mixing the second portion with one or more diluents to provide one or more fungible hydrocarbon products;

combusting at least a portion of the effluent to provide steam; and selling at least a portion of the one or more fungible hydrocarbon products to provide capital; and a second stage comprising:

mixing the hydrocarbon feed with one or more solvents and one or more non-catalytic solids to form a second mixture;

thermally cracking at least a portion of the second mixture to provide one or more hydrocarbon products and coked non-catalytic solids;

separating the coked non-catalytic solids from the one or more hydrocarbon products;

thermally regenerating the coked non-catalytic solids; and recycling at least a portion of the regenerated non-catalytic solids.

2. The method of claim 1, wherein the apportionment of the hydrocarbon feed to the first phase is ceased prior to beginning the second stage.

3. The method of claim 1, wherein selling at least a portion of the fungible hydrocarbon product provides at least a portion of the capital for the second stage.

4. The method of claim 1, wherein the cracking is performed at a temperature above the bulk critical temperature of the one or more solvents.

5. The method of claim 1, wherein one or more non-catalytic solids are added to the first mixture prior to gasification.

6. The method of claim 5, wherein the one or more non-catalytic solids comprise: refractory oxides, inert materials, combinations thereof, derivatives thereof, and mixtures thereof.

7. The method of claim 6, wherein the one or more refractory oxides are selected from a group consisting of $SiO_2$, $Al_2O_3$, $AlPO_4$, $TiO_2$, $ZrO_2$, and $Cr_2O_3$.

8. The method of claim 1, wherein the one or more non-catalytic solids comprise: refractory oxides, inert materials, combinations thereof, derivatives thereof, and mixtures thereof.

9. The method of claim 8, wherein the refractory oxides are selected from a group consisting of $SiO_2$, $Al_2O_3$, $AlPO_4$, $TiO_2$, $ZrO_2$, and $Cr_2O_3$.

10. The method of claim 1, wherein the hydrocarbon feed comprises one or more crude hydrocarbons.

11. The method of claim 1, further comprising using the steam to stimulate the production of one or more crude hydrocarbons using steam assisted gravity drainage (SAGD).

* * * * *